United States Patent [19]

Fukumori et al.

[11] Patent Number: 4,853,269

[45] Date of Patent: Aug. 1, 1989

[54] FABRIC FORM CONSISTING OF MULTILAYER FABRIC AND COMPOSITE STRUCTURE MADE BY USING FABRIC FORM

[75] Inventors: Kunihiko Fukumori, Takatsuki; Hiroshi Kikuta, Yokohama, both of Japan

[73] Assignee: Asahi Kasei Kogyo Kabushiki Kaisha, Osaka, Japan

[21] Appl. No.: 178,757

[22] Filed: Mar. 30, 1988

Related U.S. Application Data

[63] Continuation of Ser. No. 823,721, Jan. 29, 1986, abandoned.

[30] Foreign Application Priority Data

Jan. 30, 1985 [JP] Japan ..... 60-14566

[51] Int. Cl.[4] ..... B65D 65/28

[52] U.S. Cl. ..... 428/43; 139/384 R; 139/409; 428/116; 428/117; 428/178; 428/192; 428/224; 428/225; 428/229; 428/257; 428/703

[58] Field of Search ..... 139/384 R, 408, 409, 139/410, 413, 414; 28/158; 428/223, 224, 225, 229, 178, 703, 43, 192, 116, 117, 257

[56] References Cited

U.S. PATENT DOCUMENTS

| | | | |
|---|---|---|---|
| 2,741,824 | 4/1956 | Robbins et al. | 428/225 |
| 2,848,018 | 8/1958 | Neisler | 139/410 |
| 3,013,588 | 12/1961 | Klingberg | 428/225 |
| 3,517,707 | 6/1970 | Hayes et al. | 139/410 |
| 3,670,504 | 6/1972 | Hayes et al. | 139/410 |
| 3,811,480 | 5/1974 | Villiger et al. | 139/384 |
| 3,943,980 | 3/1976 | Rheaume | 428/225 |
| 4,385,648 | 5/1983 | Bindhoff | 139/384 R |
| 4,554,953 | 11/1985 | Borel et al. | 428/223 |

*Primary Examiner*—James J. Bell

*Attorney, Agent, or Firm*—Finnegan, Henderson, Farabow, Garrett & Dunner

[57] ABSTRACT

A multilayer fabric including a plurality of layers of distinct fabrics each consisting of ground warps, ground wefts, connecting warps connecting the layers of the distinct fabrics, and temporary wefts which can be broken by external action after weaving. These temporary wefts are, for example, made of weaker yarn compared with the other yarn, so when the external action is applied to the multilayer fabric, there is no chance of damaging the connecting yarn. Thus, the multilayer fabric can easily be expanded to a large thickness.

Also, a fabric form made of the multilayer fabric and composite structure made of the fabric form and filling matter.

14 Claims, 21 Drawing Sheets

FABRIC FORM CONSISTING OF MULTILAYER FABRIC AND COMPOSITE STRUCTURE MADE BY USING FABRIC FORM

This application is a continuation of application Ser. No. 823,721, filed Jan. 29, 1986, abandoned.

BACKGROUND OF THE INVENTION

1. Field of the Invention

The present invention relates to a composite structure, a fabric form to be used for the composite structure, and a multilayer fabric from which the fabric form is made. The composite structure of the present invention is formed by inserting, into the fabric form, pulverized or granular matter like soil or sand, inorganic matter, liquid or gaseous matter, or a mixture of the same, the fabric form restraining the same.

2. Description of the Related Art

A fabric form in which soil, sand, concrete, or the like is inserted between two layers of fabric has hitherto been known as a means to obtain a composite structure. However, a composite structure made of a conventional fabric form has disadvantages of unsatisfactory strength, thickness, i.e., distance between the two layers of fabrics, and appearance and several other problems. For example, a composite structure made of a conventional fabric form has a surface having large convex portions and large concave portions, i.e., it is impossible to obtain a flat surface of the composite structure. Further, since the difference between the maximum thickness and minimum thickness is large, the strength of the composite structure is irregular, being particularly low at the locations of minimum thickness. To obtain sufficient strength of the minimum thickness portions, the thickness of the maximum thickness portion is unnecessarily increased. The result is a larger quantity of material used for the fabric form and thus a higher cost. Further, there is a limit to the thickness of the conventional fabric form and it is difficult to make a composite structure having a very large thickness.

The above disadvantages of the conventional composite structure are caused by the constitution of the conventional fabric form, more exactly, the constitution of the multilayer fabric forming the conventional fabric form. A variety of multilayer fabrics have been proposed. One is obtained by connecting an upper layer fabric and a lower layer fabric at predetermined longitudinal and lateral intervals by suitable connecting members, e.g., bolts or strings. Though the thickness of this multilayer fabric can be adjusted to a large extent by adjusting the length of the connecting members or the longitudinal and lateral intervals, it is not easy to get a uniform thickness by this type of adjustments. For example, when strings are used as the connecting members 6 as illustrated in FIG. 40, since a knotting portion 51 of the strings is easily elongated, it is impossible to obtain exactly the desired thickness of the multilayer fabric or therefore, uniformity of the thickness. Further, the strength of the multilayer fabric near the point where the connecting member is attached is low, so the multilayer fabric easily breaks, and the thickness of the multilayer fabric becomes even more irregular and an appearance of the multilayer fabric becomes inferior. Further, productivity of this multilayer fabric is extremely low.

Another conventional multilayer fabric comprises layers of distinct fabrics connected together at predetermined longitudinal and lateral intervals by connecting yarns. A conventional weaving machine is unable to produce such a multilayer fabric having a sufficiently large thickness. The thickness of a multilayer fabric obtainable on a conventional weaving machine is, at most, several tens of millimeters, assuming normal longitudinal and lateral intervals. In order to construct a multilayer fabric sufficiently expandable in thickness when filled, therefore, the practice has been to connect the layers of the component fabrics at greater longitudinal and lateral intervals. This multilayer fabric, when filled, expands in thickness and contracts in area, making the surface irregular and spoiling the uniformity of thickness. Then, the large thickness of the multilayer fabric filled is caused by making largely expanded convex portions between the longitudinal and lateral intervals. This is undesirable in respect of ease of handling and the quality of the fabric form (the filled multilayer fabric). For example, since this multilayer fabric shrinks when filled, it is necessary to hang the fabric form from a chain block, fill it until it reaches the desired size, then lower it for use. Further, connection between each fabric form of this multilayer fabric is extremely difficult and considerable time is necessary for filling.

U.S. Pat. No. 3,811,480 discloses a multilayer fabric intended to solve some of these problems of the multilayer fabric. In this multilayer fabric, as illustrated in FIG. 41, the connecting warps for connecting the layers of the fabrics are inserted in loops. As a result, the length thereof is greater than that of the ground warp extending on the ground portions of the fabrics. After weaving, the layers of the fabrics are pulled apart by inserting a jig or by filling so that the loop portions of the connecting warp are drawn out between the layers of the fabrics (see FIG. 42).

In actuality, however, the loop portions of the connecting warp frequently remain held between the warp and wefts in the ground portion, i.e., it is difficult to completely draw out the loop portions. Therefore, it is difficult to obtain a constant length of the connecting warp between the fabrics. To deal with this problem, the ground warp near to the connecting warp are usually designed to have a low warp density so that the loop portions of the connecting warp can easily slide between the ground warp near to the connecting warps. In this case, however, the connecting warp become unfixed in relation with the ground weave and in some cases will slide relative to the ground weave when the expanded multilayer fabric is handled or when the fabric form made of the expanded multilayer fabric is being filled, again resulting in irregular thickness of the obtained composite structure.

Further, since the loop portions of the connecting warp are made by overfeeding the connecting warp to the ground weave, a coarse warp cannot be used as the connecting warps. As a result, a fabric form having a high pressure resistance cannot be obtained, and it is necessary to perform the filling at a relatively low pressure. This means a composite structure of a high density and a high strength cannot be obtained.

Even if this multilayer fabric is used, to enhance the thickness expandability of the fabric, it is necessary to increase the longitudinal and lateral intervals between the connected portions to increase the loop length of the connecting warp s. Therefore this multilayer fabric has the same disadvantages as the former multilayer fabric in respect to ease of handling and quality when filled. Further in this multilayer fabric, since it is impossible to use the thick connecting warp to make the same to easily slide against the ground warp near to the connecting warps, it is impossible to make the multilayer fabric having high pressure resistance. Therefore when this multilayer fabric is used as the fabric form, a filling pressure should be low pressure. It means that a composite structure having high density and high strength cannot be obtained.

SUMMARY OF THE INVENTION

Accordingly, it is an object of the present invention to provide a composite structure, formed by inserting soil, sand, concrete, or other matter into a fabric form comprised of a multilayer fabric, having high degree of surface flatness and a good appearance.

It is another object of the present invention to provide a multilayer fabric capable of making the above-mentioned composite structure and having connecting warps and temporary wefts whose engagement can be broken by external action.

The objects of the present invention are achieved by a composite structure comprising a fabric form and filling matter filled into the fabric form; the fabric form being comprised of a multilayer fabric with closed peripheral edges and at least one pouring opening, the multilayer fabric being comprised of a plurality of layers of distinct fabrics each consisting of ground warps, ground wefts, connecting warp connecting the layers of the distinct fabrics at a predetermined distance, and temporary wefts interlaced with the ground warps except for places interlaced with the connecting warps; the composite structure satisfying the following conditions:

$$\tan^{\circ} < Z < \tan 25^{\circ} \quad \text{(a)}$$

where Z indicates the flatness of a surface of the composite structure and equals h/(P/2), P (mm) being a length of an interval between two adjacent joints in the longitudinal or lateral direction of the composite structure (hereinafter referred as "pitch"), h (mm) being a height of a maximum convex portion measured from a plane including the two adjacent joints of the outermost layer of the composite structure, $$\alpha = 1 \sim 20$$

$$\beta = 0.8 \sim 1.2 \quad \text{(b)}$$

where $\alpha$ equals T/P and $\beta$ equals $\alpha n/\bar{\alpha}$, T (mm) being a thickness of the composite structure, measured from a joint of the upper layer fabric to a joint of the lower layer fabric, on being an individual value of $\alpha$, and $\bar{\alpha}$ being a mean value of $\alpha n$, $$P_W = (0.8 \sim 1.2) \cdot P_F$$

$$P_W \cdot P_F = 100 \sim 100{,}000\ mm^2 \quad \text{(c)}$$

where $P_W$ (mm) indicates the value of P (mm) in the longitudinal direction of the composite structure, and $P_F$ (mm) indicates the value of P (mm) in the lateral direction of the composite structure.

The fabric form used in the above-mentioned composite structure is preferably made of a multilayer fabric comprising a plurality of layers of distinct fabrics, each consisting of ground warps, ground wefts, connecting warp connecting the layers of the distinct fabrics, and temporary wefts which can be broken by external action after weaving without substantially damaging connecting warps; the interlaced connecting warp and the temporary wefts being able to be disengaged by subjecting the multilayer fabric to the external action, whereby the layers of the distinct fabrics are separated from each other by a predetermined distance.

Many variations of the relationship between the connecting warp and the temporary wefts are possible. For example, the temporary wefts may be arranged on both layers of the distinct fabrics and the connecting warps interlaced only with the temporary wefts in the connected portions. In this case, when the temporary wefts are broken, the connecting warp extend in an inclined direction from one layer to another. On the other hand, one or more temporary wefts may be arranged on one layer of the distinct fabrics and the connecting warps interlaced with one or more of the temporary wefts and one or more ground wefts in the ground portion of the other layer of the distinct fabrics. In this case, when the temporary wefts are broken, the connecting warps extend from one layer to another in a direction substantially perpendicular to the layer of the fabric and the connecting portions (meaning the portion of the warp between the layers, as opposed to "connected portion", meaning the region of connection with the layers) of the connecting warp are formed by sliding the connecting portion through one or more ground wefts in the connected portion.

BRIEF DESCRIPTION OF THE DRAWINGS

The present invention will be described hereinafter in connection with the accompanying drawings illustrating preferred embodiments of the present invention, in which.

DESCRIPTION OF THE PREFERRED EMBODIMENTS

Figure 1:
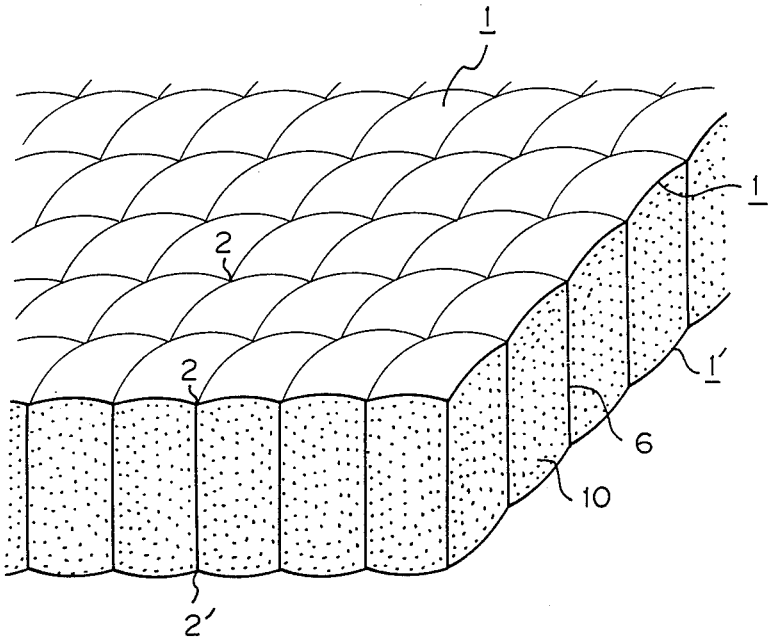
FIG. 1 is a perspective view of an example of a composite structure according to the present invention along the line X—X in FIG. 2A.
Figure 2A:
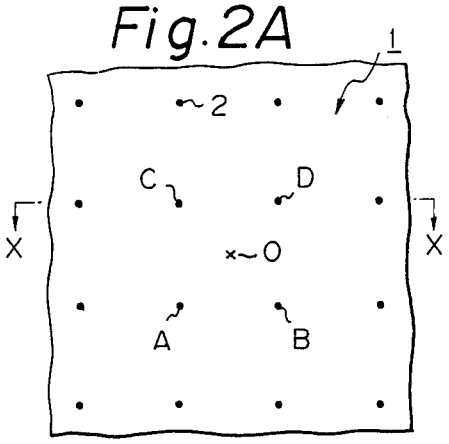
FIGS. 2A to 2C are plan views illustrating an arrangement of joints between connecting warp and ground wefts, FIG. 2A showing the case where joints are arranged in regular matrix, FIG. 2B showing the case where joints are arranged in an offset matrix, and FIG. 2C showing the case where pairs of joints are arranged in a regular matrix.
Figure 2B:
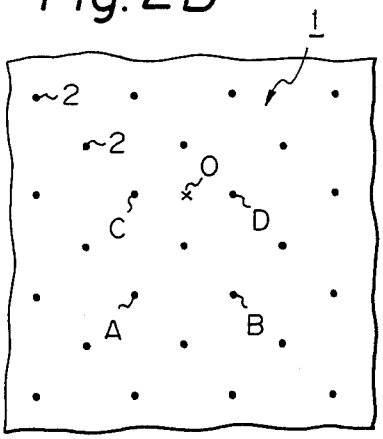
Figure 2C:
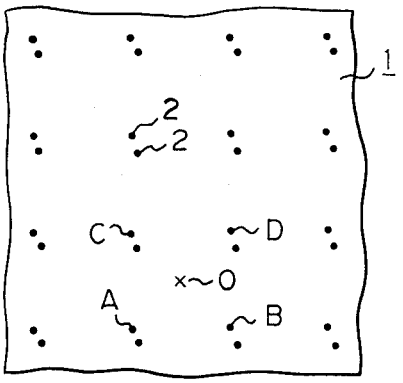

FIG. 1 shows an example of the composite structure according to the present invention. This composite structure is made by inserting filling matter 10, e.g., concrete, soil, sand, or soil including seeds, into a fabric form. This fabric form is comprised of a multilayer fabric with closed peripheral edges and at least one pouring opening. The multilayer fabric is comprised of at least two layers of distinct fabrics 1, 1' and a plurality of connecting warp 6 as described in detail hereinafter, many joints 2 and 2' connecting the connecting warp 6 to an upper layer fabric 1 or a lower layer fabric 1' appearing on a top surface and a bottom surface. As shown in FIG. 1, there are many convex portions on the top surface. FIG. 2 shows several arrangements of the joints 2. The plurality of joints 2 may be arranged in a regular matrix with points A, B, C, and D forming a square, as shown in FIG. 2A, an offset matrix, as shown in FIG. 2B, or a regular matrix with pairs of joint 2 arranged forming a square, as shown in FIG. 2C. The latter arrangement of joints 2 is applied to the composite structure explained hereinafter and shown in FIGS. 5, 6 and 7.

The composite structure according to the present invention is made by using a fabric form. The fabric form is made by using a multilayer fabric. Therefore the present invention will be explained from the multilayer fabric hereinafter.

Figure 11:
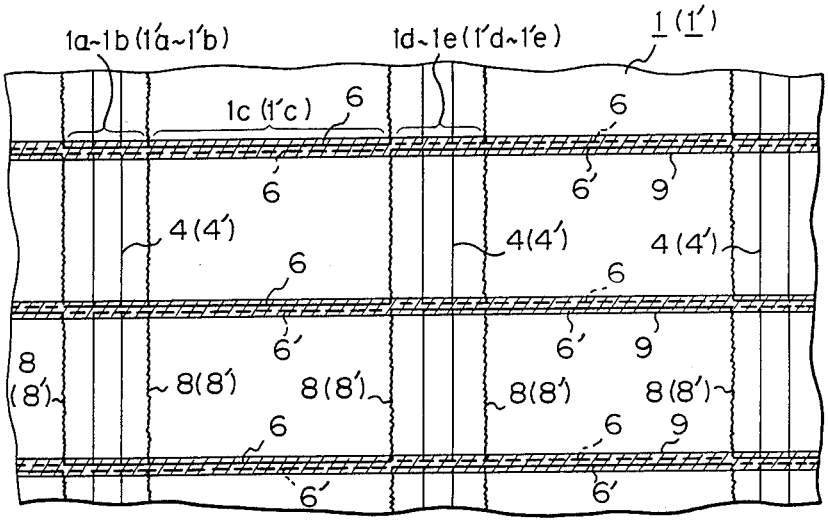
FIG. 11 is an enlarged plan view of the example of the multilayer fabric illustrated in FIG. 10.
Figure 12:
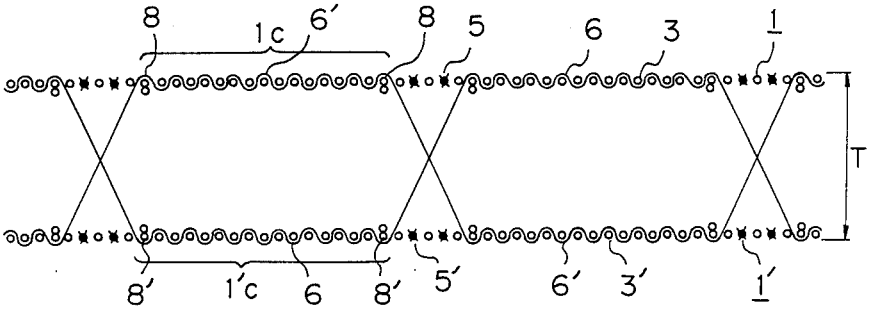
FIG. 12 is an enlarged cross-sectional view of the multilayer fabric illustrated in FIG. 10 with the temporary wefts broken and the two layers expanded.

Several examples of the multilayer fabrics are shown from FIGS. 10 to 26. These are divided into two groups, i.e., a first embodiment group shown in FIGS. 10 to 15 and a second embodiment group shown in FIGS. 16 to 26. A typical example of the first embodiment of the multilayer fabric is shown in FIGS. 10 to 12.

An upper layer fabric 1 and a lower layer fabric 1' are woven by ground wefts 3, 3' and ground warp (not shown) and are connected together at an original thickness t (thickness of an as-woven two-layer fabric) with connecting warp 6 and 6' at preselected longitudinal and lateral intervals. The connecting warp 6, 6' are woven partially into the upper layer fabric 1 and the lower layer fabric 1' so as to form a plurality of joints 1*a*, 1*b*, 1*c*, 1*d*, . . . and joints 1'*a*, 1'*b*, 1'*c*, 1'*d*, . . . of the connecting warp 6 and 6' and wefts in the upper layer fabric 1 and the lower layer fabric 1', respectively. In this example, two ground warp (not shown) have been arranged between the connecting warp 6 and the connecting warp 6' However, the two connecting warp 6 and 6' can be arranged side by side without an intermediate ground warp or one or three more ground warp may be used as the intermediate ground warps. Each of the connecting warp 6 and 6' intersects at least one weft to form the joints 1*a*, 1*b*, 1*c*, 1*d*, . . . , 1'*a*, 1'*b*, 1'*c*, 1'*d*, . . . The mode of intersection of the connecting warp 6, 6' and the wefts (weave type) and the number of intersections (length of a connected portion) are optional and are decided selectively and appropriately. Each of the connecting warp 6 and 6' is interlaced with at least one ground weft 3 or 3', as shown as the joints 1*c*, 1*f*, 1'*c*, 1'*f* in FIG. 10, respectively.

Figure 10:
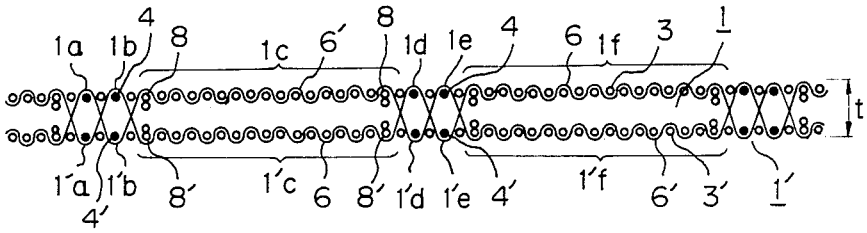
FIG. 10 is an enlarged cross-sectional view of an example of a first embodiment of the multilayer fabric according to the present invention in the state before the temporary wefts are broken.

Preferably, the number of the temporary wefts 4 and 4' interlacing with the connecting warp 6, 6' each connected portion is 1 to 20 as shown as the joints 1*a*, 1*b*, 1*d*, 1*e*, 1'*a*, 1'*b*, 1'*d*, 1'*e* in FIG. 10. When less than one, no joint is formed and, when more than ten, it is difficult to break the temporary wefts 4 and 4'.

Figure 13:
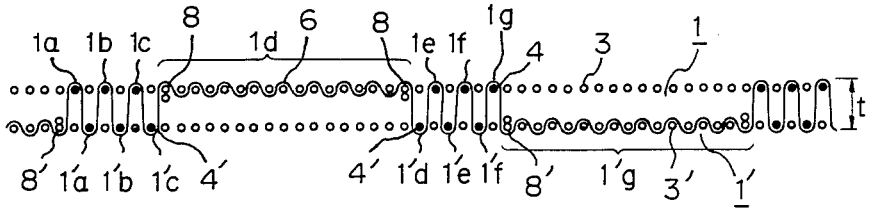
FIG. 13 is an enlarged cross sectional view of another example of the first embodiment of the multilayer fabric according to the present invention illustrated in the state before the temporary wefts are broken.
Figure 14:
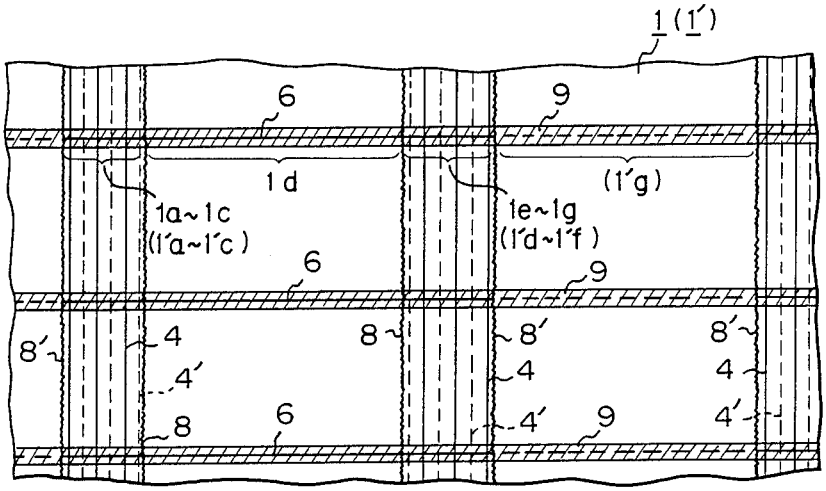
FIG. 14 is an enlarged plan view of the example of the multilayer fabric illustrated in FIG. 13.
Figure 15:
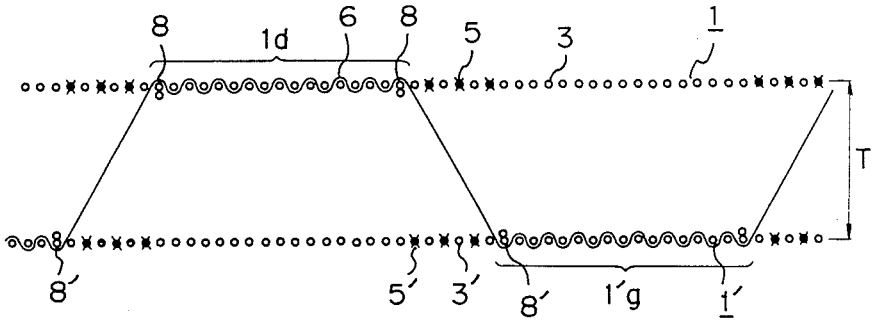
FIG. 15 is an enlarged cross-sectional view of the multilayer fabric illustrated in FIG. 13 with the temporary wefts broken and the two layers expanded.

In the multilayer fabric according to the present invention, all the temporary wefts 4 and 4' interlaced with the connecting warp 6 and 6' to form the temporary joints are broken to release portions of the connecting warp 6 and 6' forming the temporary joints from the corresponding fabrics. On the other hand, the joints formed by the connecting warp 6 and 6' and the ground wefts 3 and 3' are held in the initial state. Accordingly, as shown in FIG. 12, when the temporary joints are disengaged, the released portions of the connecting warp 6 and 6' become a connecting portion extending from the upper layer fabric 1 to the lower layer fabric 1', and the upper layer fabric 1 and the lower layer fabric 1' are separated from each other by a distance corresponding to a desired thickness T. The thickness T is not limited to any particular value. It is greatly dependent on the distribution of the temporary wefts 4 and 4', the manner of connecting the upper layer fabric 1 and the lower layer fabric 1', and the original thickness of the two-layer fabric, and is decided selectively according to the object of use of the multilayer fabric. On the basis of the constitution of the first embodiment of the multilayer fabric according to the present invention, the following equation can be used:

$$T=(N_1+1).$$

where $N_1$ is the number of temporary joints formed by the temporary wefts 4 or 4' and the connecting warps 6 or 6' in each connected portion. When t=20 mm and $N_1=6$, T=140 mm, which is far greater than the original thickness t=20 mm. The thickness T can be increased to a very large value by increasing the value of the original thickness t or the number of the temporary joints $N_1$. Thus, according to the present invention, an expanded two-layer fabric, i.e., multilayer fabric, having a thickness of ten-odd centimeters, several tens of centimeters, or several hundreds of centimeters can be produced FIGS. 13 to 15 show another example of the first embodiment of the multilayer fabric according to the present invention. As can be clearly understood when comparing FIG. 13 with FIG. 10, the example shown in FIGS. 13 to 15 is woven by using one connecting warp 6 for each connected portion. Therefore, when the multilayer fabric is expanded (see FIG. 15), one connecting portion of the connecting warp 6 extends from the upper layer fabric 1 to the lower layer fabric 1' in the direction inclined toward the layer of the fabric. The joints 2 appearing on the top face of this multilayer fabric are arranged as shown in FIG. 2A. On the other hand, the joints appearing on the top face of the multilayer fabric shown in FIGS. 10 to 12 are arranged as shown in FIG. 2C, so that two connecting warp 6, 6' extend in an X-shape from the upper layer fabric 1 to the lower layer fabric 1', as shown in FIG. 12.

The other constitution of the example shown in FIGS. 13 to 15 is substantially identical to the constitution of the example shown in FIGS. 10 to 12. Therefore, further explanation will be omitted.

Several examples of the second embodiment of the multilayer fabric according to the present invention are shown in FIGS. 16 to 26.

Figure 16:
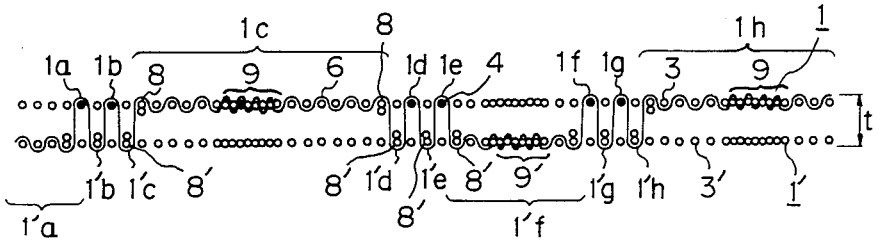
FIG. 16 is an enlarged cross-sectional view of an example of a second embodiment of the multilayer fabric according to the present invention illustrated in the state before the temporary wefts are broken.
Figure 17:
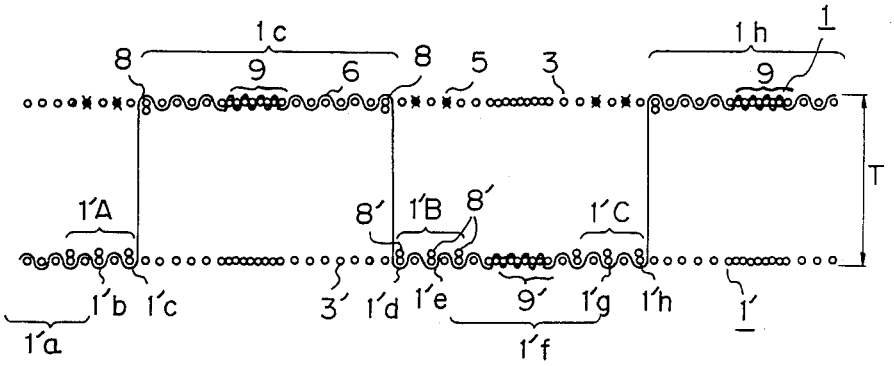
FIG. 17 is an enlarged cross-sectional view of the multilayer fabric illustrated in FIG. 16 with the temporary wefts broken and the two layers expanded.
Figure 18:
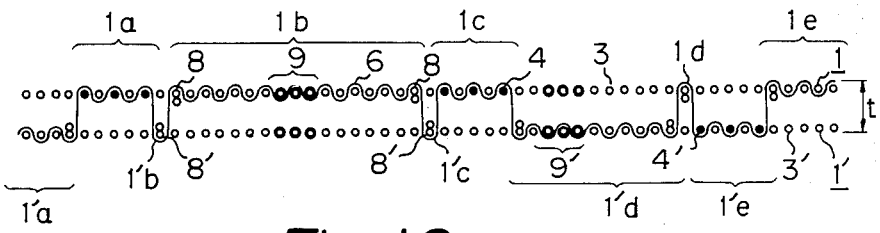
FIG. 18 is an enlarged cross-sectional view of a first variant of the second embodiment of the multilayer fabric according to the present invention illustrated in the state before the temporary wefts are broken.
Figure 19:
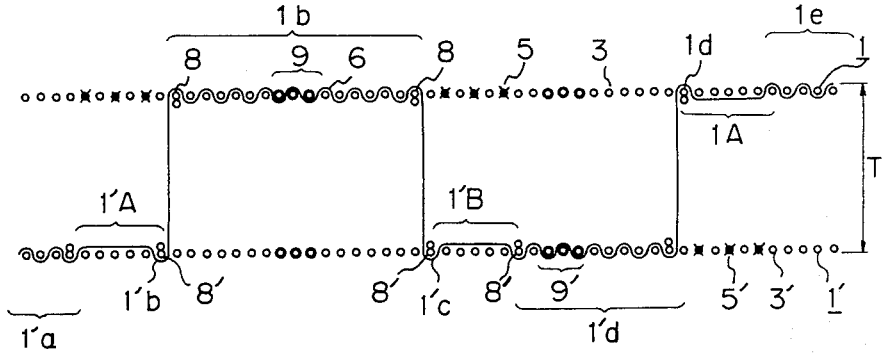
FIG. 19 is an enlarged cross-sectional view of the multilayer fabric illustrated in FIG. 18 with the temporary wefts broken and the two layers expanded.
Figure 20:
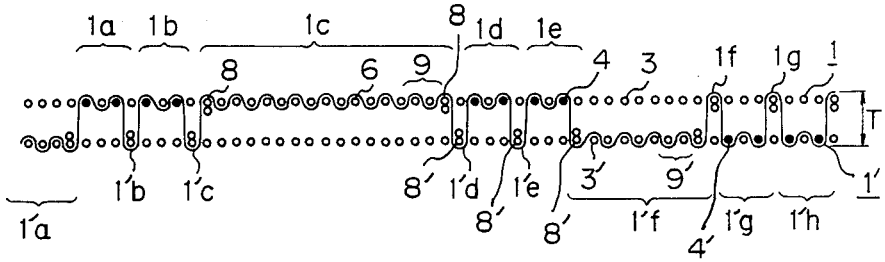
FIG. 20 is an enlarged cross-sectional view of a second variant of the second embodiment of the multilayer fabric according to the present invention illustrated in the state before the temporary wefts are broken.
Figure 21:
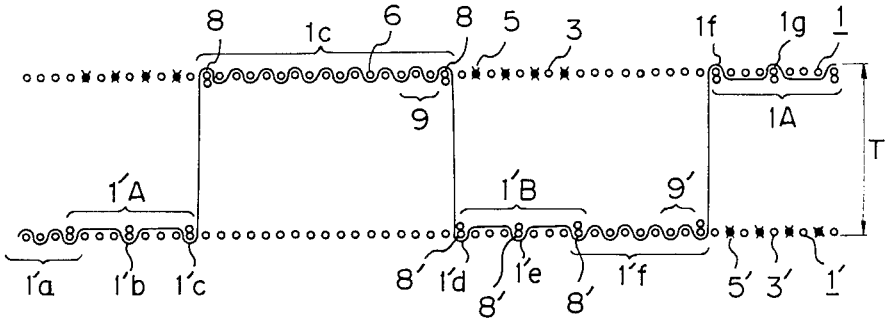
FIG. 21 is an enlarged cross-sectional view of the multilayer fabric illustrated in FIG. 20 with the temporary wefts broken and the two layers expanded.
Figure 22:
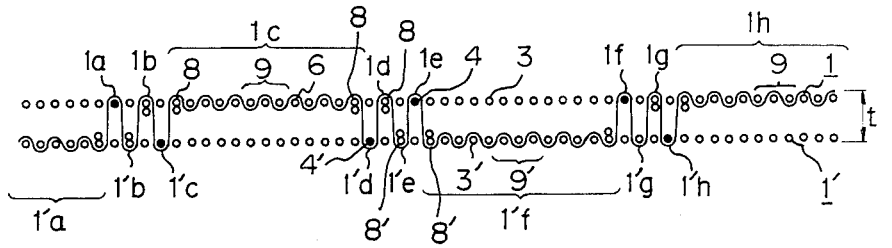
FIG. 22 is an enlarged cross-sectional view of a third variant of the second embodiment of the multilayer fabric according to the present invention illustrated in the state before the temporary wefts are broken.
Figure 23:
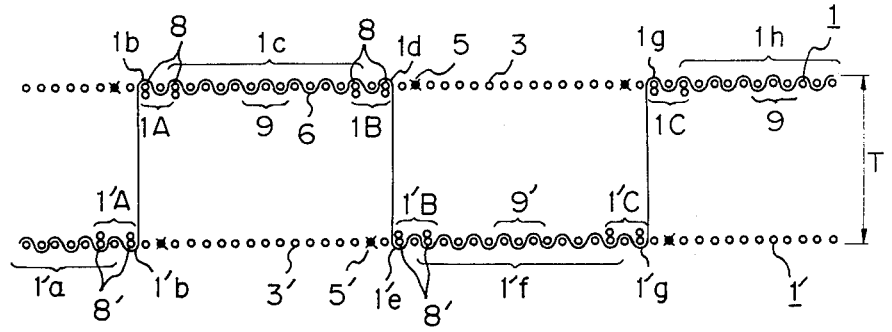
FIG. 23 is an enlarged cross-sectional view of the multilayer fabric illustrated in FIG. 22 with the temporary wefts broken and the two layers expanded.
Figure 24:
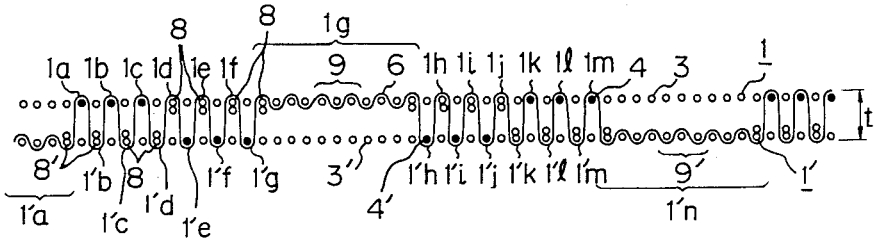
FIG. 24 is an enlarged cross-sectional view of a fourth variant of the second embodiment of the multilayer fabric according to the present invention illustrated in the state before the temporary wefts are broken.
Figure 25:
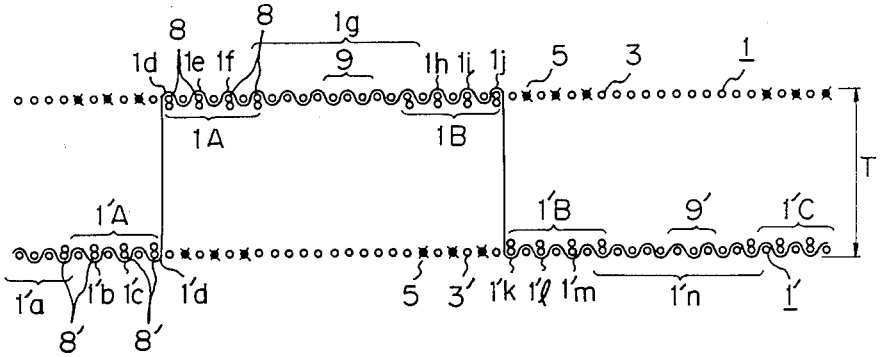
FIG. 25 is an enlarged cross-sectional view of the multilayer fabric illustrated in FIG. 24 with the temporary wefts broken and the two layers expanded.
Figure 26:
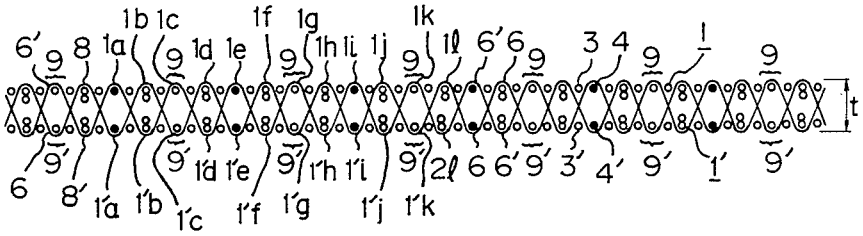
FIG. 26 is an enlarged cross-sectional view of a fifth variant of the second embodiment of the multilayer fabric according to the present invention illustrated in the state before the temporary wefts are broken.

A typical example of the second embodiment of the multilayer fabric is shown in FIGS. 16 and 17. A connecting warp 6 is interlaced with wefts at joints 1*a*, 1*b*, 1*c*, . . . in an upper layer fabric 1, and at joints 1'*a*, 1'*b*, 1'*c*, . . . in a lower layer fabric 1'. Temporary wefts 4 are interlaced with the connecting warp 6 only in the upper layer fabric 1 at joints 1*a*, 1*b*, 1*d*, 1*e*, 1*f*, and 1*g* among those points. A single temporary weft 4 is interlaced with the connecting warp at each temporary joint. At the rest of the joints, ground wefts 3 and 3' and reinforced wefts 8 and 8' are interlaced with the connecting warp 6. In expanding this fabric in thickness, the temporary wefts 4 are broken to disengage the temporary joints 1*a*, 1*b*, 1*d*, 1*e*, 1*f*, and 1*g*. Then, the released portions of the connecting warp 6 slip relative to the ground wefts 8' forming the joint 1'*b*, 1'*c*, 1'*d*, 1'*e*, 1'*g*, and 1'*h* in the lower layer fabric 1' and are added to the portions of the connecting warp 6 originally extending between the upper and lower layer fabrics 1 and 1', as shown in FIG. 17. The reinforced wefts 8' forming the joints 1'*b*, 1'*c*, 1'*d*, 1'*e*, 1'*g*, and 1'*h* and the connecting warp 6 interlaced therewith form new structures 1'A, 1'B, and 1'C.

On the basis of the constitution of the second embodiment of the multilayer fabric according to the present invention, the following equation can be used:

$$T=(2N_2+1).$$

where $N_2$ is the number of temporary joints formed by the temporary wefts. Therefore, the thickness T of the expanded fabric shown in FIG. 17 is approximately five times the original thickness t of the fabric.

Many variant examples of the multilayer fabric of the second embodiment can be made by changing the arrangement of the temporary weft 4 and the ground wefts 3, 3' in the upper layer fabric and the lower layer fabric 1'. Five variant examples are shown in FIGS. 18 and 19, FIGS. 20 and 21, FIGS. 22 and 23, FIGS. 24 and 25, and FIG. 26. The temporary wefts 4 are indicated with black dots and the broken temporary wefts 5 with x'ed out black dots. FIGS. 18, 20, 22, 24, and 26 show the variant multilayer fabrics in the state before the temporary wefts 4, 4' is broken, and FIGS. 19, 21, 23, and 25 show them in the state after the temporary wefts 4, 4' is broken. The essential constitution of these examples is similar to the example shown in FIGS. 16 and 17, therefore further explanation will be omitted.

There is no limitation on the type of fibers, type of yarns, the finish, and the sectional shape of the fibers of textiles for forming the multilayer fabric of the present invention.

Textiles applicable to forming the multilayer fabric of the present invention, by way of example, are spun yarns or filaments of natural fibers, such as those of cotton, flax, jute, and wool, inorganic fibers, such as those of metals, glass, and carbon, regenerated fibers, such as those of cellulose and protein, and synthetic fibers, such as those of, polyamides, polyesters, polyolefins, polyurethanes, polystyrenes, polyvinyl chlorides, polyvinylidene chlorides, polyacrylonitrile and polyvinyl alcohols. Ordinary fibers having a circular cross-section, fibers having an irregular cross-section, foam fibers, and conjugate fibers may be used. There is no limitation on the diameter of fibers. Those fibers may be used individually or in combination. The yarns may be finished through a physical process or a chemical process. The conditions of the textile are selectively and appropriately decided according to the object of use, the mode of use, and the application of the multilayer fabric.

There is no particular limitation on the structure, weave type and morphology of the multilayer fabric of the present invention; the weave type may be plane weave, twill weave, satin weave, or figured weave; the structure may be entirely or partially a two-layer structure, a three-layer structure, four-layer structure, or any multilayer structure; and the method of connecting the component layers of distinct fabrics may be the method of the present invention or a combination of the method of the present invention and another method (a method of partially and closely joining the layers, a method of connecting the layers with a gap therebetween, or a combination of these methods). The weave type, the number of layers, the structure, and the manner of connecting the layers are selectively and appropriately decided according to the object of use, the mode of use, and the application of the multilayer fabric.

This multilayer fabric is woven on an ordinary multiple shed loom. The multilayer fabric are woven through at least one shedding device by inserting alternately a weft to warp in a lower layer or warp in an upper layer, or inserting simultaneously a plurality of weft to the warp in the lower layer and the warps in the lower layer, while the connecting warp are supplied from a separate source of the connecting warp other than those of the ground warps. In weaving portions corresponding to the joints, the yarn feed rate is regulated. Further this multilayer fabric can be made by a knitting machine e.g., a raschel warp knitting machine.

The multilayer fabric of the present invention may be integrated with another woven fabric or fabrics, a knit fabric or fabrics, a nonwoven fabric or fabrics, or a net or nets, may be provided with other members, or may be finished through a physical or chemical process.

"Breakage of the joint of the connecting warp by external action" in the present invention means that the breakage of the temporary weft is broken by physical force, thermal treatment, or chemical treatment or drawing out the temporary weft from the multilayer fabric.

In the case where the temporary weft is broken by physical force, a temporary weft having weak strength is used. The weak temporary weft is broken by applying pressure or a load at the time of filling the filling matter or by inserting a jig between two layers of the multilayer fabric before filling the filling matter.

The strength of the weak temporary weft should be lower than that of the connecting warp . It is preferable to use a weak temporary weft having a strength in the range of 0.1 to 0.001 time the strength of the connecting warp. If the strength of the weak temporary weft is over 0.1 time the strength of the connecting warp, there is a chance the weak temporary weft will not break suitably and the connecting warp will destroy the weave of the multilayer fabric at the time that the multilayer fabric is separated by physical force. If the strength of the weak temporary weft is under 0.001 time the strength of the connecting warp, it is impossible to weave the multilayer fabric under a regular condition and the weak temporary weft breaks frequently during the weaving operation. Even if the multilayer fabric can be woven by that weak temporary weft, it is impossible to obtain a multilayer fabric having a preset thickness, i.e., the woven multilayer fabric will have an irregular thickness.

As far as the weak temporary weft satisfies the above-mentioned condition, there is no particular limitation on the selection of the weft and it can be selected according to the weave, the object of use, the mode of use, and the application of the multilayer fabric. Preferably, low strength multifilaments like rayon multifilament, acetate multifilament, acrylic multifilament, or the like, spun yarns of rayon staple, acrylic staples or the like, or fine denier multifilaments of a polyester multifilament or a polyamide multifilament are used.

In the case where the temporary weft is broken by thermal treatment, a heat meltable yarn is used. A yarn having a low melting point under 150° C. is usually used as the heat meltable yarn. To prevent influence of heat against the other yarns constituting the multilayer fabric, a yarn having a melting point 10° C. or more lower than the melting points of the other yarns is preferably used. Further, the other yarn should be low shrinkable and low deformable. If a heat meltable yarn which does not satisfy the above conditions is used, the multilayer fabric is frequently destroyed, is deformed, or causes irregularities in the thickness of the multilayer fabric at the time that the multilayer fabric is heated and the temporary weft is broken.

As far as the heat meltable yarn satisfies the above-mentioned condition, there is no particular limitation on the selection of the yarn and it can be selected according to the weave, the object of use, the mode of use, and the application of the multilayer fabric. For example, if yarns made of natural fibers like as cotton, flax, wool, or the like, inorganic fibers like as metal, glass, carbon, or the like, regenerated fibers like cellulose, protein, or the like, or synthetic fibers like as polyamide, polyester, polyacryl, polyvinyl alcohol, or the like are used as the other yarn constituting the multilayer fabric, it is preferable to use yarns made of polyolefin, polyvinyl chloride, polyvinylidene chloride, polyester of low melting point, polyamide of low melting point, or the like as the heat meltable yarn.

In the case where the temporary weft is broken by chemical treatment, a yarn which can be dissolved or degraded by water, acid, alkali, a solvent, steam, or the like, is used as the temporary weft. In this case, yarns which do not dissolve or degrade by the above medium, e.g., water and further do not shrink or deform should be used as the other yarns constituting the multilayer fabric. If other yarns which do not satisfy the above conditions are used, the multilayer fabric is frequently destroyed, is deformed, or causes irregularities in the thickness of the multilayer fabric or becomes weak at the time that the multilayer fabric is treated by the above medium.

As far as the soluble temporary weft satisfies the above-mentioned condition, there is no particular limitation on the selection of the soluble temporary weft and the soluble temporary weft can be selected according to the weave, the object of use, the mode of use, and the application of the multilayer fabric. The following combinations of the soluble temporary weft and the other yarns are recommendable for this use. A first combination is that of a soluble temporary weft of a water soluble fiber, e.g., polyvinyl alcohol, and other yarns of a non-water soluble fiber, e.g., polyamide fiber. A second combination is that of a soluble temporary weft of an acid soluble fiber, e.g., polyamide fiber, and other yarns of a non-acid soluble fiber, e.g., polyester fiber. A third combination is that of a soluble temporary weft of an alkali soluble fiber, e.g., polyester fiber, and other yarns of a non-alkali soluble fiber, e.g., polyamide fiber. However, in consideration of easy manufacture of the soluble temporary weft and easy treatment, it is more preferable to use a water soluble yarn of, for example, denatured polyvinyl alcohol, denatured polyacrylonitrile, denatured cellulose, or the like capable of easily being dissolved by cool or hot water or steam.

In the case where the temporary weft is drawn out from the multilayer fabric, the weave of the temporary weft is loosely made and a temporary weft having a smooth surface which can easily slide on the corresponding warp is used. Therefore, it is preferable that the temporary weft be woven in a float weave or a pile weave and a monofilament yarn or a twisted multifilament yarn be used. Further, it is preferable to use thicker yarn than the ground wefts and the ground warp as the temporary weft.

In the present invention, when a joint is disengaged, the released portion of a connecting warp , or the total of the released portion of the connecting warp and a portion of the same connecting warp pulled out from the portion of the same interlacing with the ground wefts extends between the adjacent layers of the distinct fabrics when the adjacent layers of the distinct fabrics are moved away from each other, so that the adjacent layers of the distinct fabrics are separated from each other by a desired distance. The thickness of the multilayer fabric thus expanded is at least twice that of the original (as-woven) multilayer fabric. The thickness of the expanded multilayer fabric is greatly dependent on the connecting mode, the morphology of the joint and the mode of disengagement. It is possible to produce a multilayer fabric which is capable of expanding in thickness by several times to several tens times that of the original (as-woven) thickness, by selectively and appropriately deciding these factors dominating the expansion of the multilayer fabric.

The multilayer fabric of the present invention is capable of forming an expanded multilayer fabric having a very large thickness even if the thickness of the original multilayer fabric, namely, as-woven multilayer fabric, is small, however, the greater thickness of the original multilayer fabric (as-woven) further facilitates the disengagement of the joints, further facilitates the expansion in thickness, and enhances the quality of the expanded multilayer fabric.

Accordingly, the initial thickness of the as-woven multilayer fabric of the present invention is at least 3 mm and, preferably, 10 mm or above. When the initial thickness is less than 3 mm, an increased number of temporary wefts need to be removed or disintegrated requiring difficult work to expand the multilayer fabric, a lean expanded multilayer fabric is formed, or the insertion of the connecting warp in a high density is impossible, and hence the quality of the product, namely, the expanded multilayer fabric filled with a filling matter, is not satisfactory.

The multilayer fabric of the present invention is expanded in thickness at the stage of an as-woven multilayer fabric, a semifinished multilayer fabric finished in a fixed size, or a process for filling the multilayer fabric with a filling matter. The stage for disengaging the joints and expanding the multilayer fabric is not limited to any particular stage but may be selectively decided according to the weave type, the object of use, the mode of use, and the application of the multilayer fabric.

In the multilayer fabric of the present invention, it is preferable that an additional weft for reinforcing a ground weft be provided at a place from where a connecting portion of the connecting yarn extends toward the adjacent layer. The reinforcing yarns are shown in FIGS. 10 to 26 as the numeral 8 and 8'. Of course, a stronger weft than the other ground wefts may be used in place of putting the additional yarn. This additional weft or the stronger weft may be applied to the other ground weft over which the connecting warp slips as shown in, for example, FIG. 16. By using the additional weft or the stronger yarn at the above-mentioned place, it is possible to prevent the weave of the multilayer fabric from being deformed or the ground weft arranged on the above-mentioned place from being broken when the adjacent layers of the multilayer fabric are separated by applying external force or a fabric form made of a multilayer fabric already separated in adjacent layers thereof is filled with the filling matter so that the strong force is applied to the ground weft at the above-mentioned place.

There is no particular limitation on the additional weft or the strong weft. They can be selected according to the weave, the strength of the temporary weft, the object of use, the mode of use, and the application of the multilayer fabric.

In the present invention, there is a chance that the connecting warp will slip in the longitudinal direction against the ground weft when the multilayer fabric is expanded or the fabric form made of the multilayer fabric is filled with the filling matter. If slippage of the connecting warp occurs, the thickness between layers becomes irregular. Therefore, it is preferable to fix the connecting warp to the ground weave. The connecting warp is fixed in two ways by increasing the coefficient of friction of the connecting warp against the ground wefts interlacing with the connecting warp and/or the ground warp neighboring the connecting warp and by fixing the connecting warp to the ground weave by using additional means, e.g., adhesive tape.

The coefficient of friction of the connecting warp is increased by increasing partially or wholly a cover factor of a portion along the connecting warp in the warp direction, weft direction, or both directions of the each layer of the multilayer fabric.

The cover factor K is defined by the following equation:

$$K=f/\sqrt{N}\cdot q$$

where f is the number of yarns per inch,

N is the cotton count, q is defined by $\sqrt{\rho_c/\rho_f}$ and a conversion factor from cotton fiber to other fibers, $\rho_c$ is the specific gravity of the cotton, $\rho_f$ is the specific gravity of the fiber used There are two methods of increasing the cover factor. One is increasing the warp density of the ground warp at both sides of the connecting warp or by using thick ground warp as the ground warp of both sides of the connecting warp, as shown by numeral 9 of FIGS. 11 and 14. Another is increasing the weft density of the ground wefts at a part of the connected portion as shown in by numeral 9 of FIG. 16 or by using thick ground wefts as the ground wefts on the part of the connected portion as shown by numeral 9 of FIG. 18. The above methods may be used together. Further, a yarn having small convex and concave portions on the surface thereof, such as a yarn composed of a plurality of single filaments having an irregular cross-section, a yarn composed of a plurality of single filaments having a different denier, or a twist yarn can be used as the connecting warp or the ground wefts arranged to make the portion having the high cover factor. Yarn having fuzz on the surface thereof or yarn finished with a suitable resin or rubber may also be used.

The cover factor suitable for preventing slippage of the connecting warp is not less than 13.

Another fixing system is adhering the connecting warp with the ground weft by means of an adhesive, e.g., resin, rubber, adhesive tape, or heat sensible adhesive tape, by melting the connecting warp and the ground weft to each other, or by sewing a suitable place of the multilayer fabric where the connecting warp is interlaced with the ground wefts.

The above two fixing systems can be used together. Further, systems other than the above can also be used, as far as the slippage of the connecting warp can be prevented.

The weave, warp density, and weft density of the multilayer fabric of the present invention are decided selectively and appropriately according to the object of use and the mode of use. For example the weave, the warp density, and weft density are selected such that the multilayer fabric are not broken by the filling pressure and weight of the filling matter, abrasion with the ground or the like, or a tearing force when the multilayer fabric is used as the fabric form filled with a solid filling matter, e.g., concrete. The strength of one layer of the multilayer fabric is preferably not less than 50 kg per inch of width and the strength of the connecting warp at a point where the connecting warp interlaces with the ground weft is preferably not less than 50 kg. Further, it is preferable that the multilayer fabric have good drainability of surplus water when the filling matter is poured into it. Toward this end, it is preferable that the multilayer fabric have a plurality of apertures from 0.01 $mm^2$ to 4 $mm^2$ area between the ground warp and the ground wefts.

The multilayer fabric can be used after being resin-finished, rubber-laminated, or dyed to improve the abrasion strength, appearance, or other functional properties.

Figure 27:
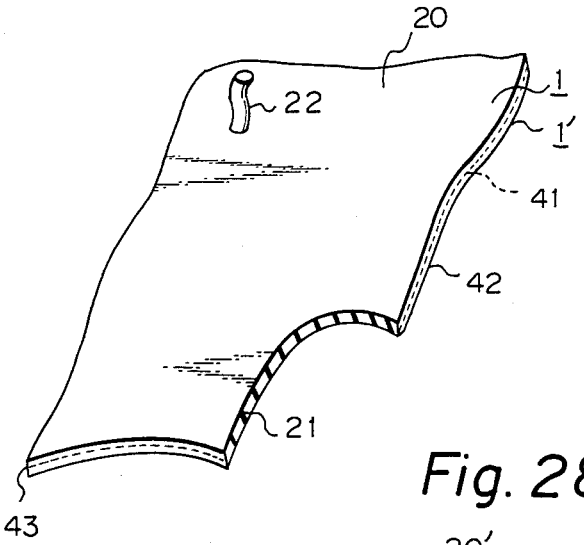
FIG. 27 is a perspective view of an example of a fabric form according to the present invention illustrated in the state before the two layers are expanded.
Figure 28:
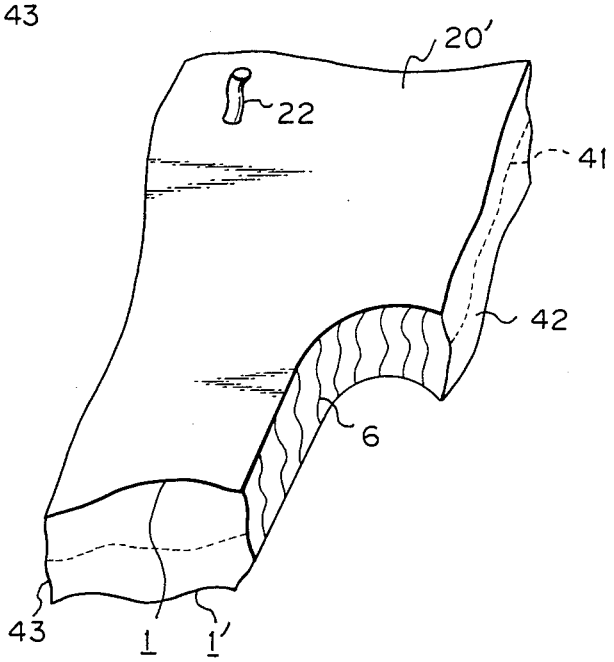
FIG. 28 is a perspective view of the fabric form illustrated in FIG. 27 with the two layers expanded.

A fabric form according to the present invention can be made by closing peripheral edges 41 of the multilayer fabric of the present invention and providing at least one pouring opening 22 on a suitable position of the multilayer fabric, as shown in FIGS. 27 and 28.

The fabric form preferably has a width from 1 m to 10 m and a length from 1 m to 50 m. The peripheral edges of the multilayer fabric are preferably closed by sewing or adhering. One or several pouring openings are provided on a surface or the peripheral edges of the multilayer fabric. The pouring openings may be arranged either in the longitudinal direction or lateral direction of the fabric form.

The fabric form of the present invention has essentially a uniform thickness and shape when expanded each layer of the multilayer fabric constituting the fabric form is of substantially the same constitution. However, if necessary, another layer which does not satisfy the above conditions of the multilayer fabric of the present invention may be used as either the front layer or back layer of the fabric form. Further, one-lay portion constructed as a drain of the water may be arranged in the multilayer fabric of the fabric form. To reinforce the pressure resistance, a one-layer wall portion or the like may be provided at a suitable portion of the fabric form. To improve the fillability of the filling matter, a supporting member of a hose for filling through the pouring opening into the fabric form may be provided on the fabric form.

Breakage of the temporary wefts, explained hereinbefore, may be performed in several stages, i.e., breakage in the multilayer fabric, breakage performed by applying suitable action explained hereinbefore to the fabric form before filling the filling matter, or breakage performed by filling the filling matter into the fabric form. Therefore, the present invention includes a multilayer fabric having temporary wefts which are not broken, a multilayer fabric having broken temporary wefts, a fabric form made of the multilayer fabric having the unbroken temporary wefts, a fabric form made of the multilayer fabric having broken temporary wefts, and the composite structure explained in detail hereinafter with the temporary wefts constituting the multilayer fabric broken by filling the filling matter or other processing.

We will now explain the constitution of the composite structure.

The composite structure of the present invention is comprised of the fabric form and filling matter filled into the fabric form. It has remarkable features of good flatness, good appearance, and uniform thickness. Therefore, the composite structure of the present invention satisfies three important conditions.

Figure 3:
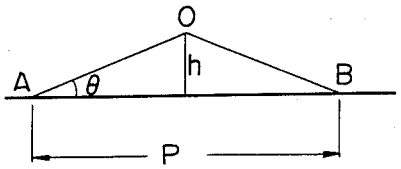
FIG. 3 is a view explaining the determination of the degree of flatness of the composite structure.

The first condition is $\tan 0° < Z < \tan 25°$. Z indicates the flatness of the surface of the composite structure and equals h/(P/2). P (mm) is the length of an interval between two adjacent joints, e.g., A, B, C, and D as shown in FIG. 2A. h(mm) is the height of a maximum convex portion measured from a plane including the two adjacent joints of the outermost layer of the composite structure as shown in FIG. 3. When the value of Z is large, the irregularity of the surface of the composite structure, i.e., the difference of the height of the convex portion of the composite surface, becomes large. When the value of Z is small, the irregularity of the surface of the composite structure becomes small and the surface is nearly flat. This condition must be satisfied at longitudinal and lateral directions of the composite structure. At least five values of Z are measured at random portions of the surface of the composite structure. The mean value of the middle three values is used as the numeral indicating the flatness of the composite structure.

If Z equals tan0°, h becomes 0 and the surface of the composite structure become completely plain. But it is impossible to satisfy this state when the fabric form is used. If Z exceeds tan25°, h becomes too large and the composite structure has an inferior flatness, a weak strength, and a deformed shape, resulting in a poor appearance. For example, when the pitch P (distance between two adjacent joints in the longitudinal or lateral direction of the composite structure made of the fabric form filled with the filling matter) after filling matter becomes big compared with the pitch $P_0$ before filling, the surface of the fabric form expands outward, h is increased, and Z becomes a big value. Even if no shrinkage of the fabric form occurs during the insertion of the filling matter, when the fabric form is extended greatly, the surface of the fabric form expands outward by a length corresponding to the extension of the fabric form and Z become too large by an increment of h.

The second condition of the composite structure of the present invention is as follows:

$$\alpha = 1 \sim 20$$

$$\beta = 0.8 \sim 1.2$$

Figure 4:
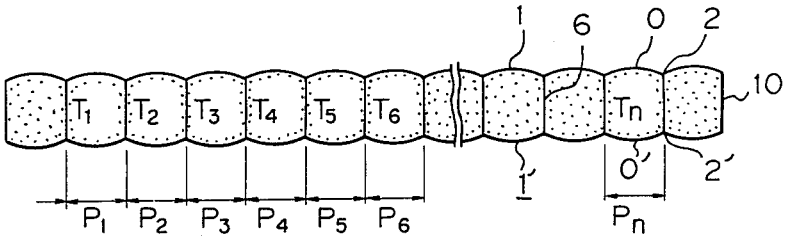
FIG. 4 is a cross-sectional view of the example of the composite structure illustrated in FIG. 1.

$\alpha$ equals T/P, and $\beta$ equals $\beta n/\bar{\alpha}$. T (mm) is a thickness of the composite structure, measured from a joint of the upper layer fabric to a joint of the lower layer fabric, $\alpha n$ is an individual value of $\alpha$, and $\bar{\alpha}$ is a mean value of $\alpha n$. FIG. 4 shows a plurality of Tn and Pn of an example of the composite structure of the present invention. The value of T can be measured by inserting a bar into the composite structure before its being hardened or by measuring the thickness between a top (point o) of the convex portion of the outmost layer and the top (point o') of the convex portion of the underside layer and subtracting twice the value of h from the above thickness. The value of $\alpha$ should be measured at least at five points selected at random on the surface of the composite structure and in the longitudinal and lateral directions, respectively.

In the composite structure, since $\alpha$ equals 1 to 20, i.e., the pitch P is selected to be equal to or small than the height T, expansion of the surface of the composite structure becomes small and the composite structure has a surface which is nearly plane. Further, since $\beta$ equals 0.8 to 1.2, the irregularity of flatness of the composite structure becomes small and there is only a small irregularity in strength at a portion of the composite structure.

If $\alpha$ is smaller than 1, the irregularity of the surface is too large. If $\alpha$ is larger than 20, the height T become extremely large compared to the pitch P and the composite structure becomes wrong in shape. Further, if $\beta$ is less than 0.8 or more than 1.2, the height T or the pitch P become irregular, uniformity of dimensions of the composite structure is lost, and the shape and strength of the composite structure are adversely affected.

The third condition of the composite structure of the present invention is as follows:

$$P_W = (0.8 \sim 1.2) \cdot P_F$$

$$P_W \cdot P_F = 100 \sim 100{,}000 \text{ mm}^2$$

$P_W$(mm) indicates the value of P (mm) in the longitudinal direction of the composite structure, and $P_F$(mm) indicates the value P(mm) in the lateral direction of the composite structure. Since, in the composite structure of the present invention, $P_W$ nearly equals $P_F$, the convex portion on the composite structure has a nearly regular square shape and results in a uniform appearance. If $P_W$ is less than 0.8 $P_F$ or greater than 1:2 $P_F$, the convex portion has a rectangular shape, resulting in an irregular appearance and a difference in strength between the longitudinal direction and the lateral direction of the composite structure.

The value of $P_W \cdot P_F$ decides the size of one convex portion of the composite structure. If $P_W \cdot P_F$ is less than 100, the pitches $P_W$ and $P_F$ are small and there are too many connecting warps. Therefore, the filling of this composite structure becomes difficult. If $P_W \cdot P_F$ is more than 100,000, the pitch $P_W$ and $P_F$ are too large and the composite structure has many large convex portions and irregular heights.

The above three conditions are preferably satisfied on both surfaces, i.e., the top surface and bottom surface. However, a composite structure with just one surface satisfying the three conditions is possible available.

Figure 5:
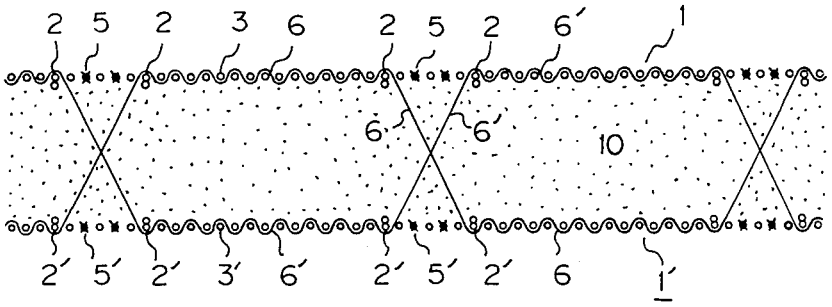
FIG. 5 is an enlarged cross-sectional view of an example of the composite structure according to the present invention.
Figure 6:
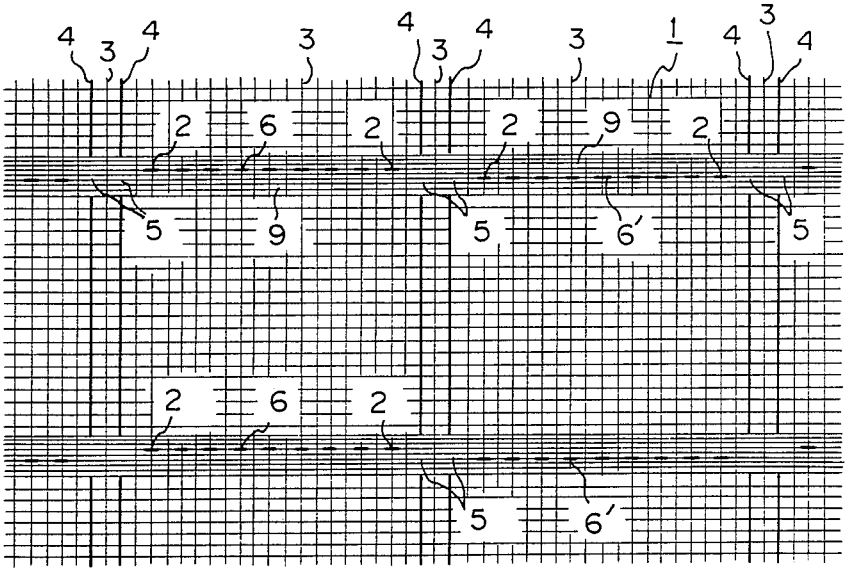
FIG. 6 is an enlarged plan view of the example of the composite structure illustrated in FIG. 5.
Figure 7:
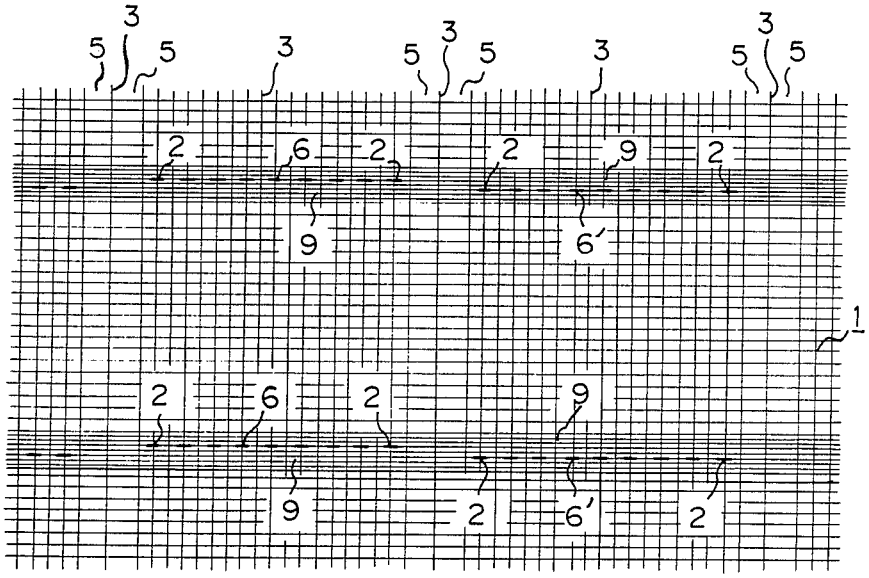
FIG. 7 is an enlarged plan view of a composite structure similar to that illustrated in FIG. 5 except that the temporary wefts are completely removed.

Several examples of the composite structures according to the present invention are shown in FIGS. 5 to 9. FIGS. 5 and 6 show a composite structure made of the multilayer fabric shown in FIG. 10. In FIGS. 5 and 6, the temporary wefts 4 are broken at points indicated by the numeral 5. The numeral 10 indicates filling matter, and the numeral 9 indicates a portion arranged with additional ground warp to increase the cover factor in the warp direction. The composite structure shown in FIG. 7 is similar to the composite structure shown in FIGS. 5 and 6, but different in that the temporary wefts 4 are completely pulled out and spaces 5 are arranged on the surface of the composite structure.

Figure 8:
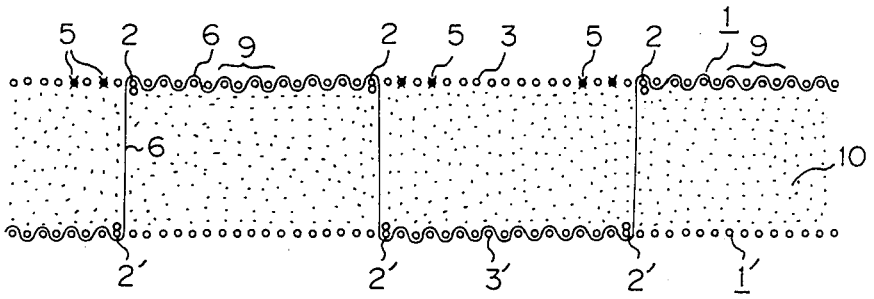
FIG. 8 is an enlarged plan view of another example of a composite structure according to the present invention.
Figure 9:
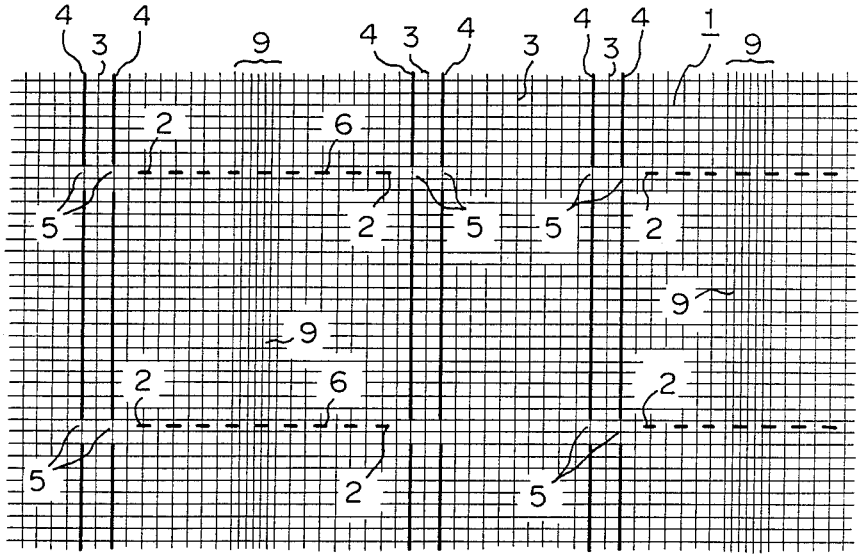
FIG. 9 is an enlarged plan view of the example of the composite structure illustrated in FIG. 8.

FIGS. 8 and 9 show a composite structure made of the multilayer fabric shown in FIG. 16. In this composite structure, the temporary wefts 4 are broken at points indicated by the numerals 5. In this composite structure, portions 9 fixing the connecting warp 6 are arranged in the weft direction.

Concrete, soil, sand, soil including seeds, etc. are used as the filling matter of the composite structure of the present invention. The filling matter is inserted into the fabric form in a flowable state prepared by adding water.

Since the multilayer fabric used for the composite structure has the connecting warp extending in a direction substantially perpendicular to the surface of the composite structure, insertion of the filling matter into the fabric form results in only a little shrinkage of the fabric form. Therefore, the design of the fabric form and manufacture of the composite structure are easy.

The method for manufacturing or using the composite structure of the present invention will be explained hereinafter.

The composite structure of the present invention can be used on a horizontal surface or an inclined surface. In special cases, the composite structure can be used as a structure having an arc shape or a tubular shape.

When the composite structure is used on an inclined ground surface, first the fabric form is spread on the inclined surface and the top portion fixed on the top shoulder portion of the ground by means of a chain block or the like. Though it is necessary to put a plurality of stakes through the fabric form into the ground to fix the composite structure, this operation may be performed while inserting the filling matter into the fabric form or after all portions of the composite structure are filled with the filling matter.

Figure 29:
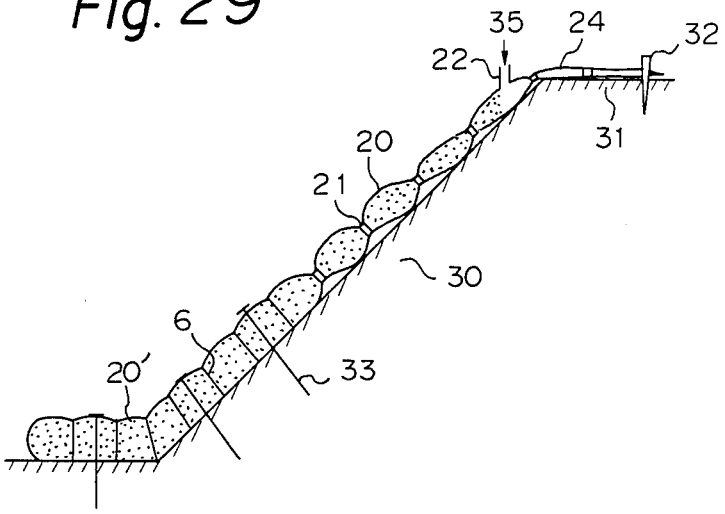
FIG. 29 is a side view illustrating an example of the use of the fabric form according to the present invention the form arranged on a plain inclined surface and filling matter poured into the fabric form.
Figure 30:
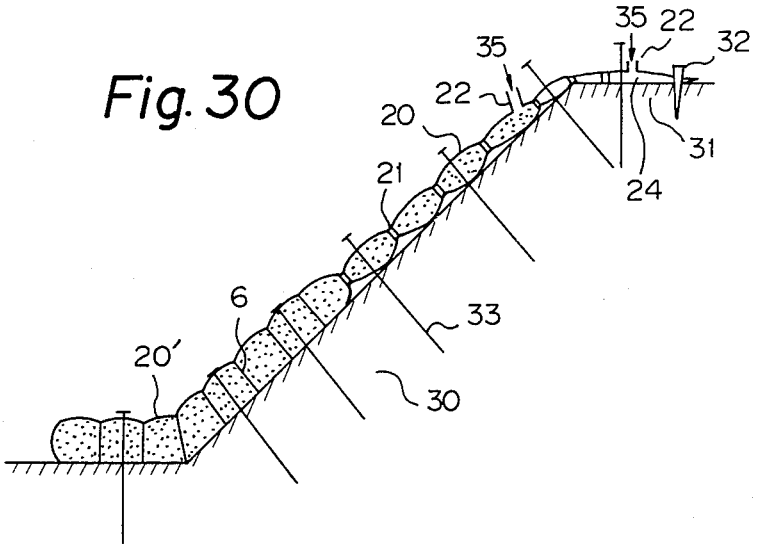
FIG. 30 is side view illustrating another example of the use of the fabric form.
Figure 31:
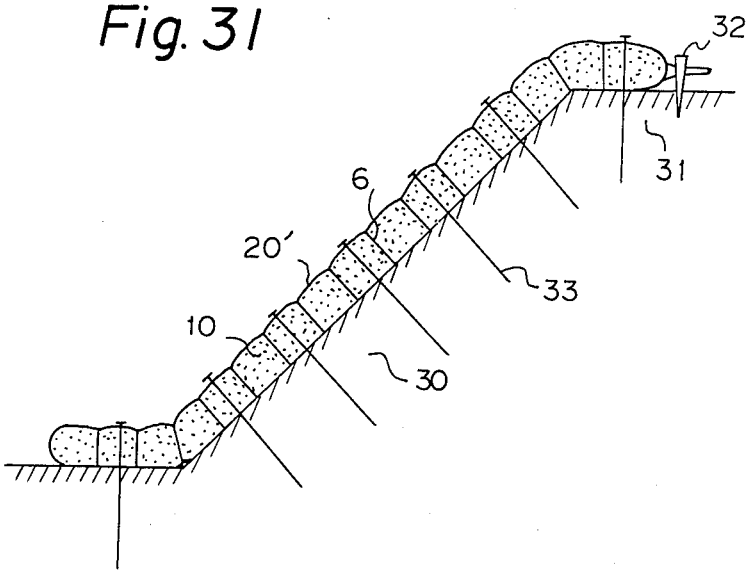
FIG. 31 is a side view of an example of the composite structure according to the present invention on a plain inclined surface.

FIGS. 29 to 31 show the case where the composite structure is made on a flat inclined ground surface. The fabric form 20 before being expanded is spread on the ground 30 and the top portion thereof is fixed on a shoulder portion 31 by a stake 32, as shown in FIG. 29. The filling matter, mixed with water, is inserted into the fabric form 20 from a pouring opening 22 in the direction indicated by an arrow. The filling matter breaks portions 21 of the temporary wefts where connect the two layers of the fabric form and forms the composite structure from a bottom side to a top side. A stake 33 is inserted into the ground 30 every time a portion of the composite structure is formed. The number of stakes may be from 0.5 to 3 per square meter of the composite structure.

FIG. 30 shows a case where all necessary stakes are put into the ground 30 before filling to fix the fabric form 20. The number of stakes in this case may be from 1 to 5 per square meter of the composite structure. Of course, the length of stake 33 protruding from the ground 30 should be determined in consideration of the height of the composite structure after inserting the filling matter.

FIG. 31 shows the composite structure obtained by using the method shown in FIG. 29 or 30.

Figure 32:
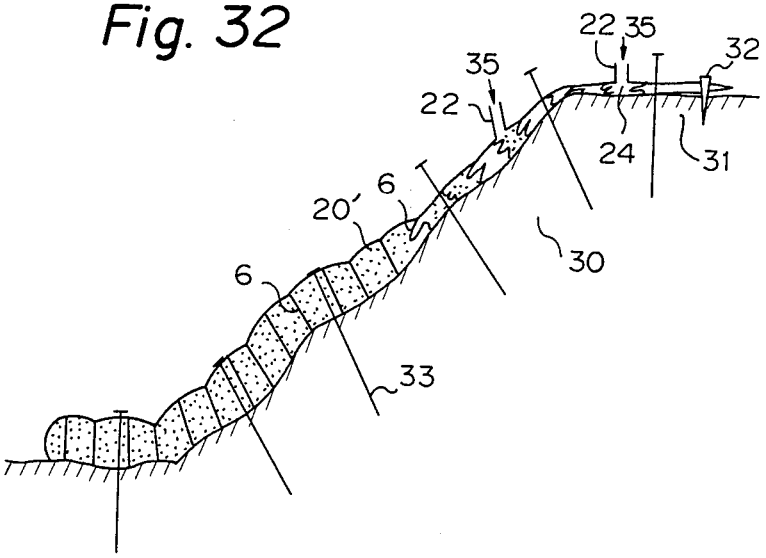
FIG. 32 is a side view of an example of the use of the fabric form according to the present invention, the form arranged on an irregular inclined surface and filling matter poured into the fabric form.
Figure 33:
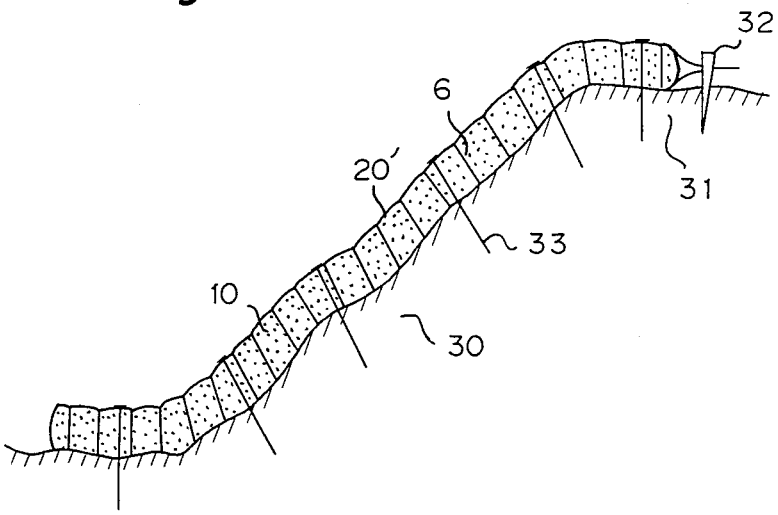
FIG. 33 is a side view of an example of the composite structure according to the present invention on an irregular inclined surface.

FIG. 32 shows the case where a preexpanded fabric form 20' is spread on an irregular inclined ground surface 30 and fixed to the ground by means of the stakes 33. The number of stakes in this case may be from 1 to 5 per square meter. FIG. 33 shows the composite structure obtained by using the method in FIG. 32.

Figure 34:
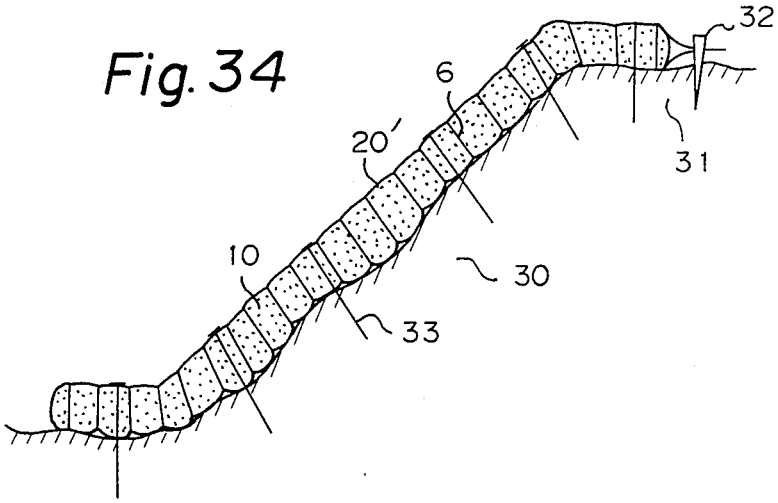
FIG. 34 is a side view of an example of the composite structure according to the present invention arranged on an irregular inclined surface and having a top plain surface.
Figure 35:
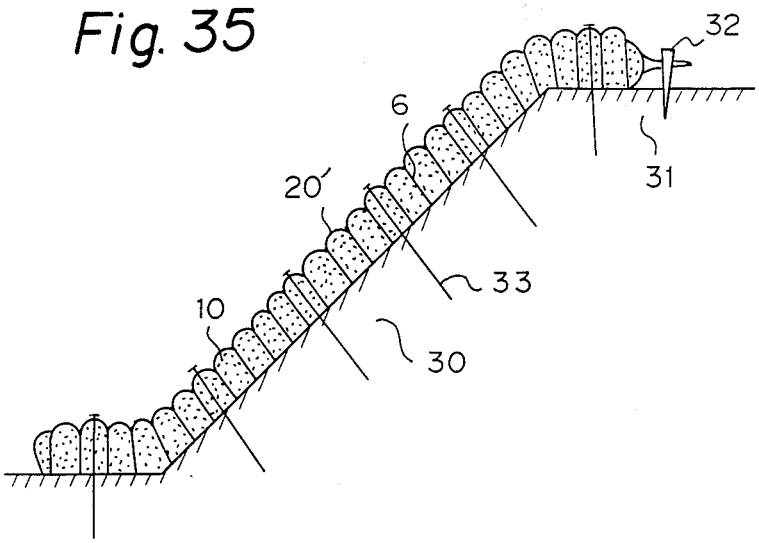
FIG. 35 is a side view of an example of the composite structure according to the present invention arranged on a plain inclined surface and having a top convex surface.

In the cases shown in FIGS. 31 and 33, the top surface of the composite structure substantially follows the ground surface. However, if the bottom layer of the fabric form is made of highly extendable yarns and the top layer of the fabric form is made of yarns of low elongation, it is possible to make the top surface of the composite structure flat as shown in FIG. 34, even when this fabric form is used on an irregular ground surface. On the other hand, if the bottom layer of the fabric form is made of yarns of low elongation and the top layer of the fabric form is made of highly extendable yarns, when used on a plain ground surface, this composite structure has high fillability on the ground 30 and an irregular shape on the top surface, as shown in FIG. 35, which serves to eliminate waves or reduce the speed of fluids.

Figure 36:
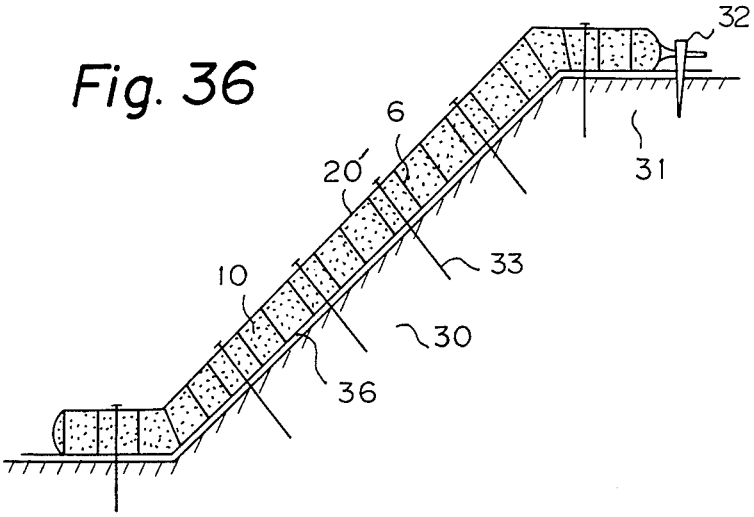
FIG. 36 is a side view of an example of the composite structure according to the present invention arranged through a drain passage on a plain inclined surface.

If necessary, the composite structure may be used with a drain passage 36 attached to a back side thereof, as shown in FIG. 36.

Figure 37:
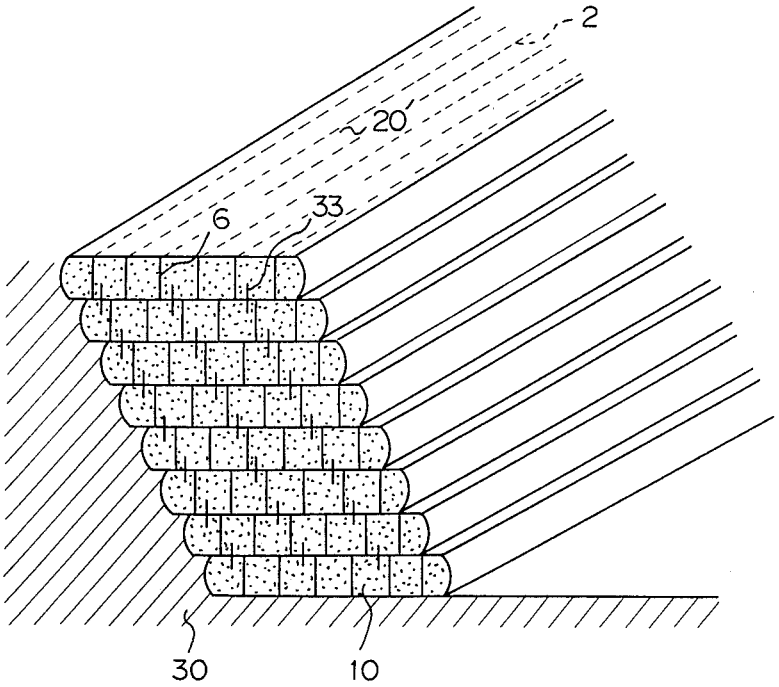
FIG. 37 is a perspective view of a plurality of composite structures according to the present invention superimposed along an inclined surface.

Further, the composite structure can be used as super-imposed composite structures shown in FIG. 37. In this case, the several composite structures are connected by a plurality of stakes 33 and serve to make a river wall or a sea wall. Since the composite structure of the present invention has a uniform thickness and flat surface, it is easily to superimpose many composite structures to efficiently make a uniform river or sea wall.

Figure 38:
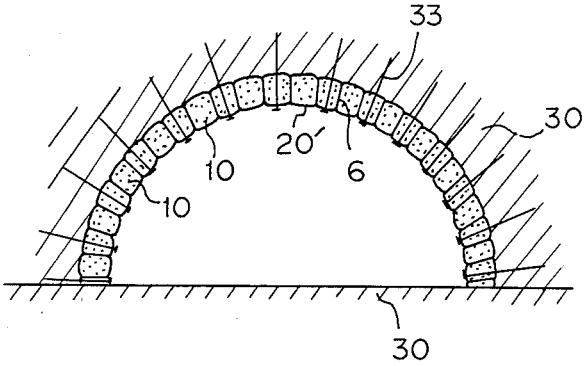
FIG. 38 is a front view of a composite structure according to the present invention arranged on an inside wall of a tunnel.

The composite structure of the present invention may be used as an inside wall of a tunnel as shown in FIG. 38. Since the composite structure of the present invention has a plain surface, it is possible to make a uniform curved surface. Further, since the thickness is uniform, the strength of the composite structure used as the tunnel is also uniform.

Figure 39:
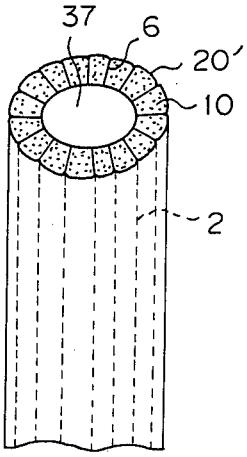
FIG. 39 is a perspective view of a composite structure according to the present invention made into a tube.
Figure 40:
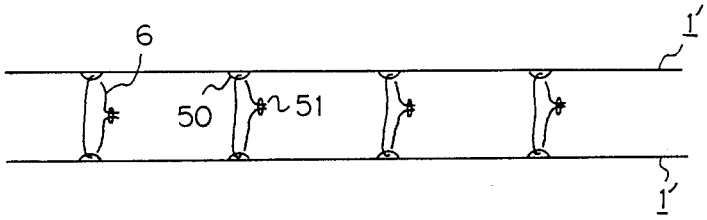
FIG. 40 is a cross-sectional view of a multilayer fabric of the prior art.
Figure 41:
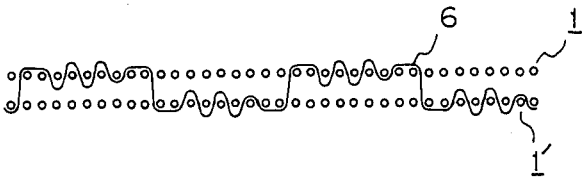
FIG. 41 is an enlarged cross-sectional view of another multilayer fabric of the prior art.
Figure 42:
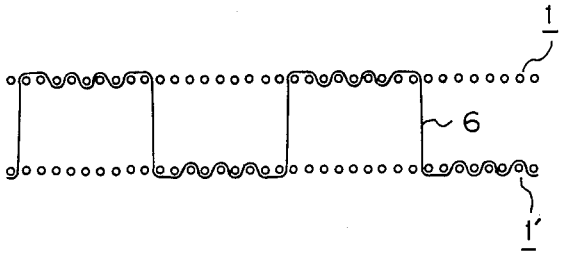
FIG. 42 is an enlarged cross-sectional view illustrating the state where the multilayer fabric illustrated in FIG. 41 is expanded.

If the composite structure of the present invention is formed in a tubular shape as shown in FIG. 39, this composite structure can be used as a housing for repairing a pile.

The filling matter is preferably filled under pressure by a pump. The suitable pressure is from 0.05 kg/cm$^2$ to 2.0 kg/cm$^2$. If the pressure is less than 0.05 kg/cm$^2$, surplus water does not drain from the fabric form and obstructs the formation of a composite structure having a high density when concrete is used as the filling matter. It also decreases the mass of the filling matter, since the water only gradually escapes from the composite structure. When the water later evaporates, the filling matter undesirably shifts downward, when composed of soil, and, or soil including seeds. A pressure more than 2.0 kg/cm$^2$ is too strong for the fabric form, so the fabric form would have to be made stronger, and economic and handling disadvantages would arise.

When using concrete as the filling matter, the concrete should be flowable mortar or a flowable concrete having a little more water than conventional mortar or concrete. If necessary, an agent for accelerating flowability, short cut fiber for increasing the strength, or a dispersing agent for increasing the blend ratio of an aggregate or the short cut fiber may be added to the filling matter.

When using soil or sand as the filling matter, it is preferable to use 20% to 70% water compared with the net weight of the soil or the sand. Of course, it is necessary to remove impurities such as roots of plants over 50 mm in maximum length thereof. If necessary, an agent for accelerating flowability, a dispersing agent, an adhesive agent, or an agent for increasing viscosity may be added to the soil or the sand.

Soil or sand including seeds can be used as the filling matter. Fertilizer may also be added to the filling matter. It is preferable to add over 500 g seeds per 1 m$^3$ of volume of the total filling matter and to add over 50 kg fertilizer per the same.

In addition to the above filling matter, resin, water, air, or the like may be used as the filling matter When the composite structure is used for keeping a fluid such as air, water, or oil, it is preferable to coat the both surface of the fabric form with an airtightness means, e.g., rubber.

The composite structure according to the present invention can be applied for many applications, for example, a sea wall, river wall, false set dam, air dome, tent, boat, container, anti-noise wall, buffer material, float, or the like.

The present invention will now be explained further by means of examples, which is no way limit the invention.

COMPARATIVE EXAMPLE 1

A two-layer fabric of 20 mm original thickness having connected portions distributed at longitudinal intervals of 200 mm and lateral intervals of 50 mm was woven of ground warp and ground wefts each of 840 denier nylon filament yarn in warp and weft density of 22 threads/inch. The upper and lower layer fabrics were connected at the connected portions with connecting warp of 10,000 denier nylon filament yarns. Each connecting warp was woven in the ground structure so that the length thereof between the adjacent longitudinal connected portions is 2.5 times that of the distance (80 mm in this two-layer fabric) between the adjacent longitudinal connected portions. That is, the length of the connecting warp between the adjacent longitudinal connected portions is longer than the distance between those connected portions by 120 mm (excessive portion). The periphery of the two-layer fabric was sewn and a pouring opening was attached to the upper layer fabric to made a fabric form 2 m wide×5 m long. The fabric form was laid over the surface of a slope and fastened thereto with stakes. Fluid concrete (water-to-cement ratio: 65%) was poured into the fabric form by a concrete pump at a pressure of approximately 0.4 kg/cm$^2$. The excessive portions of the connecting warp moved relative to the ground structure and extended between the upper and lower layer fabrics to expand the fabric form in thickness. As shown in Table 1, an unsatisfactory composite structure having irregular shape, excessively irregular surface, and irregular thickness was formed. The fabric form contracted in size greatly.

COMPARATIVE EXAMPLE 2

A two-layer fabric of 20 mm original thickness having connected portions distributed at longitudinal intervals of 100 mm and lateral intervals of 100 mm was woven of ground warp and ground wefts each of 840 denier nylon filament yarn in warp and weft density of 22 threads/inch. The upper and lower layer fabrics were connected at the connected portions with connecting warp of 10,000 denier nylon filament yarns. Each connecting warp was woven in the ground structure so that the length thereof between the adjacent longitudinal connected portions is twice that of the distance (60 mm in this double layer fabric) between the adjacent longitudinal connected portions. That is, the length of the connecting warp between the adjacent longitudinal connected portions is longer than the distance between those connected portions by 60 mm (excessive portion). The upper and lower layer fabrics were separated from each other with a tool, and then the periphery of the two-layer fabric was sewn and a pouring opening was attached to the upper layer fabric to form a fabric form approximately 2 m wide×5 m long. The fabric form was laid over the surface of a slope and fastened thereto with pegs. Fluid concrete (water-to-cement ratio: 65%) was poured into the fabric form by a concrete pump at a pressure of approximately 0.5 kg/cm$^2$. As shown in Table 1, an unsatisfactory composite structure having irregular shape, excessively irregular surface, and irregular thickness was formed. The fabric form contracted in size greatly.

TABLE 1

| | Characteristics | | Controls 1 | Controls 2 |
|---|---|---|---|---|
| Z | Longitudinal | Mean | 0.21 | 0.40 |
| | | Max | *0.59 | *0.69 |
| | | Min | 0.03 | 0.20 |
| | Lateral | Mean | *0.91 | 0.41 |
| | | Max | *2.70 | *0.71 |
| | | Min | 0.12 | 0.20 |

TABLE 1-continued

| | Characteristics | | Controls 1 | Controls 2 |
|---|---|---|---|---|
| $\alpha$ | Longitudinal | Mean | *0.81 | *0.94 |
| | | Max | 1.04 | 1.26 |
| | | Min | *0.57 | *0.73 |
| | Lateral | Mean | 3.50 | *0.96 |
| | | Max | 4.75 | 1.29 |
| | | Min | 2.29 | *0.73 |
| $\beta$ | Longitudinal | Max | *1.28 | *1.34 |
| | | Min | *0.70 | *0.78 |
| | Lateral | Max | *1.36 | *1.34 |
| | | Min | *0.65 | *0.76 |
| $P_W/P_F$ | | | *4.34 | 1.02 |
| $P_W \cdot P_F$ mm$^2$ | | | 8,404 | 8,648 |
| Areal contraction of the fabric form (%) | | | 16.0 | 13.5 |

Note
Asterisk (*) refers to values not meeting the conditions of the present invention.

EXAMPLES 1 TO 9

Two-layer fabrics of different constructions according to the present invention having warp and weft density of 22 threads/inch were prepared. The following yarns were used:

840 d nylon filament yarn . . . Ground warp and weft
30,000 d nylon filament twist yarn . . . Connecting warp
20's/2 rayon spun yarn . . . Temporary weft
10,000 d×3 nylon filament yarn . . . Reinforced weft Connected portions were distributed at longitudinal intervals of 100 mm and lateral intervals of 100 mm. In areas of 5 mm width on opposite sides of each connecting warp, the ground warps were arranged in a higher warp density of 40 threads/inch so that the cover factor of those areas is approximately 16.

At each connected portion, one, five, or 10 temporary wefts were inserted into each of the upper and lower layer fabrics to interlace each connecting warp with the temporary wefts at two, 10 or 20 joints so that three, 11, or 21 connecting portions of the connecting warp extend between the upper and lower layer fabrics, respectively. The respective original thickness (t) of the two-layer fabrics were 10 mm, 20 mm, or 40 mm. These specifications of the two-layer fabrics are tabulated in Table 2.

The periphery of each two-layer fabric was sewn and a pouring opening was attached to the two-layer fabric to form a fabric form of approximately 2 m×3 m size. The weave of these two-layer fabrics was the same as those of FIGS. 10 and 11. The fabric form was extended from the top of a readjusted slope over the surface of the same (FIG. 29), and then fluid concrete (water-to-cement ratio: 65%) was poured into the fabric form at a pressure of approximately 0.4 kg/cm$^2$. The rayon spun yarns, namely, the temporary wefts, were broken and the fabric form was expanded in thickness to form a composite structure consisting of the fabric form and concrete. The characteristics of the composite structures corresponding to Examples 1 to 9 are tabulated in Table 3. The composite structures of Examples 2, 3, and 5 to 9 had flat surfaces and uniform thicknesses over the entire area thereof and the external appearances of the same were satisfactory. When the fabric forms were filled with concrete to form the composite structures, no significant contraction in size occurred in the fabric forms. The lower surface of each composite structure was laid in close contact with the surface of the corresponding slope.

TABLE 2

| Ex. No. | Original thickness (mm) | Number of connecting portions | Thickness of the composite structure (mm) |
|---|---|---|---|
| 1 | 10 | 3 | 30 |
| 2 | " | 11 | 110 |
| 3 | " | 21 | 220 |
| 4 | 20 | 3 | 60 |
| 5 | " | 11 | 220 |
| 6 | " | 21 | 420 |
| 7 | 40 | 3 | 120 |
| 8 | " | 11 | 440 |
| 9 | " | 21 | 840 |

TABLE 3

| Characteristics | | | Examples 1 | 2 | 3 | 4 | 5 | 6 | 7 | 8 | 9 |
|---|---|---|---|---|---|---|---|---|---|---|---|
| Z | Longitudinal | Mean | *0.90 | 0.41 | 0.36 | *0.80 | 0.40 | 0.32 | 0.24 | 0.20 | 0.16 |
| | | Max | *0.97 | 0.44 | 0.38 | *0.85 | 0.44 | 0.36 | 0.29 | 0.24 | 0.20 |
| | | Min | *0.86 | 0.36 | 0.34 | *0.77 | 0.36 | 0.30 | 0.22 | 0.18 | 0.14 |
| | Lateral | Mean | *0.91 | 0.41 | 0.36 | *0.80 | 0.40 | 0.32 | 0.24 | 0.20 | 0.16 |
| | | Max | *0.97 | 0.44 | 0.38 | *0.85 | 0.44 | 0.36 | 0.29 | 0.24 | 0.20 |
| | | Min | *0.88 | 0.36 | 0.34 | *0.77 | 0.36 | 0.30 | 0.22 | 0.18 | 0.14 |
| $\alpha$ | Longitudinal | Mean | *0.38 | 1.24 | 2.36 | *0.71 | 2.33 | 4.40 | 1.38 | 4.58 | 8.81 |
| | | Max | *0.41 | 1.28 | 2.41 | *0.69 | 2.38 | 4.49 | 1.40 | 4.65 | 8.90 |
| | | Min | *0.36 | 1.19 | 2.29 | *0.66 | 2.24 | 4.33 | 1.32 | 4.51 | 8.73 |
| | Lateral | Mean | *0.38 | 1.24 | 2.36 | *0.71 | 2.33 | 4.40 | 1.38 | 4.58 | 8.81 |
| | | Max | *0.41 | 1.28 | 2.41 | *0.69 | 2.38 | 4.49 | 1.40 | 4.65 | 8.90 |
| | | Min | *0.36 | 1.19 | 2.29 | *0.66 | 2.24 | 4.33 | 1.32 | 4.51 | 8.73 |
| $\beta$ | Longitudinal | Max | 1.08 | 1.03 | 1.02 | 0.97 | 1.02 | 1.02 | 1.01 | 1.02 | 1.01 |
| | | Min | 0.95 | 0.96 | 0.97 | 0.93 | 0.96 | 0.98 | 0.96 | 0.98 | 0.99 |
| | Lateral | Max | 1.08 | 1.03 | 1.02 | 0.97 | 1.02 | 1.02 | 1.01 | 1.02 | 1.01 |
| | | Min | 0.95 | 0.96 | 0.97 | 0.93 | 0.96 | 0.98 | 0.96 | 0.98 | 0.99 |
| $P_W/P_F$ | | | 1.01 | 1.00 | 1.00 | 1.00 | 1.00 | 1.00 | 1.00 | 1.00 | 1.00 |
| $P_W \cdot P_F$ mm$^2$ | | | 8,556 | 9,409 | 9,801 | 9,025 | 9,801 | 10,000 | 9,604 | 10,000 | 10,000 |
| Area contraction of the fabric form (%) | | | 14.4 | 6.0 | 2.0 | 9.8 | 2.0 | 0 | 4.0 | 0 | 0 |

Note:
Asterisk (*) refers to values not meeting the conditions of the present invention.

EXAMPLES 10 TO 15

Two-layer fabrics of different constructions according to the present invention, each having a warp and weft density of 22 threads/inch and original thickness (t) of 20 mm were prepared. The following yarns were used:

840 d nylon filament yarn . . . Ground warp and weft
30,000 d nylon filament twist yarn . . . Connecting warp
20's/2 rayon spun yarn . . . Temporary weft
10,000 d×3 nylon filament yarn . . . Reinforced weft Connected portions were distributed at longitudinal×lateral intervals of 8 mm×8 mm (Example 10), 30 mm×30 mm (Example 11), 100 mm×100 mm (Example 12), 300 mm×300 mm (Example 13), 50 mm×100 mm (Example 14), and 100 mm×50 mm (Example 15).

At each connected portion, three rayon spun yarns, namely, the temporary wefts, were inserted in the upper and lower layer fabrics to interlace each connecting warp with the temporary wefts at six joints so that seven connecting portions of the connecting warp extend between the upper and lower layer fabrics, respectively. In areas of 5 mm width on opposite sides of each connecting warp, the ground warps were arranged in a higher warp density of 40 threads/inch so that the cover factor of those areas is approximately 16.

The periphery of each two-layer fabric was sewn and a pouring opening was attached to the two-layer fabric to form a fabric form approximately 2 m wide×3 m long. The weave of these two-layer fabrics is the same as those of FIGS. 10 and 11. The fabric form was extended from the top of a readjust slope over the surface of the same (FIG. 29), and then fluid concrete (water-to-cement ratio: 65%) was poured through the pouring opening into the fabric form at a pressure of approximately 0.4 kg/cm$^2$ to form a composite structure consisting of the fabric form and concrete. The characteristics of the composite structures corresponding to Examples 10 and 15 are tabulated in Table 6. The composite structure of Examples 11 and 12 had flat surface and uniform thicknesses over the entire area thereof and the external appearances of the same were satisfactory. When the fabric forms were filled with concrete to form the composite structures, no significant contraction in size occurred in the fabric forms; and the lower surface of each composite structure was laid in close contact with the surface of the corresponding slope.

EXAMPLES 16 TO 24

Two-layer fabrics of different constructions according to the present invention, each having a warp and weft density of 22 threads/inch and original thickness (t) of 20 mm were prepared. The following yarns were used:

840 d nylon filament yarn . . . Ground warp and weft
30,000 d nylon filament twist yarn . . . Connecting warp
10,000 d×3 nylon filament yarn . . . Reinforced weft
Temporary wefts for temporary weft breaking system
- 50 d nylon filament yarn (Tensile strength: approx. 300 g)
- 10's/2 rayon spun yarn (Tensile strength: approx. 1.1 kg)
- 300 d PET yarn (Tensile strength: approx. 23 kg)

Temporary wefts for temporary weft dissolving system
- 300 d water-soluble Vinylon yarn (Solblon SS made by Nichibi Co.)
- 315 d water-soluble Vinylon yarn (Solblon MH made by Nichibi Co.)

Temporary wefts for temporary weft melting system
- 1000 d PVC yarn
- 1000 d PP yarn Temporary wefts for temporary weft extracting system
- 3000 d PET monofilament (Ground weave)
- 3000 d PET monofilament (Float weave)

Connected portions were distributed at longitudinal×lateral intervals of 100 mm×100 mm.

At each connected portions, three temporary wefts each were inserted into the upper and lower layer fabrics to interlace each connecting warp with the temporary wefts at six joints so that seven connecting portions of the connecting warp extend between the upper and lower layer fabrics, respectively. In areas of 5 mm width on opposite sides of each connecting warp, the ground warps were arranged in a higher warp density of 40 threads/inch so that the cover factor of those areas is approximately 16.

The two-layer fabrics were subjected to a water treatment (temporary weft dissolving system), mechanical breaking process (temporary weft breaking system), heat treatment (temporary weft melting system), or hooking-out process (temporary weft extracting system) to prepare the two-layer fabrics for use. Then, the periphery of each two-layer fabric was sewn and a pouring opening was attached to the two-layer fabric at one end thereof to form a fabric form approximately 2 m wide×3 m long. The constructions of the two-layer fabrics are the same as those of FIGS. 10 and 11. The fabric form was extended from the top of a readjust slope over the surface of the same (FIG. 29), and then fluid concrete (water-to-cement ratio: 65%) was poured through the pouring opening into the fabric form at a pressure of approximately 0.4 kg/cm$^2$ to form a composite structure consisting of the fabric form and concrete. The characteristics of the composite structures corresponding to Examples 16 to 24 are tabulated in Table 4. The characteristics of the composite structures of Examples 17, 19, 21, and 23 were practically the same as those of Example 12. As regards the rest of the examples, Example 16 had problems in weaving and Examples 18, 20, 22, and 24 had problems in disengaging the joints in the connected portions, and hence the fabric forms of these two-layer fabrics were incapable of being filled with concrete or did not meet the conditions of the present invention. The lower surface of each of the composite structures of the two-layer fabrics meeting the conditions of the present invention was laid in close contact with the surface of the corresponding slope.

EXAMPLES 25 TO 29

Two-layer fabrics of different constructions according to the present invention, each having a warp and weft density of 22 threads/inch and original thickness (t) of 20 mm were prepared. The following yarns were used:

840 d nylon filament yarn . . . Ground warp and weft
30,000 d nylon filament twist yarn . . . Connecting warp
20's/2 rayon spun yarn . . . Temporary weft
10,000 d×2 nylon filament yarn . . . Reinforced weft Connected portions were distributed at longitudinal×lateral intervals of 100 mm×100 mm. At each connected portion, three temporary wefts each were inserted in the upper and lower layer fabrics to interlace each connecting warp with the temporary wefts at six joints so that seven connecting portions of the connecting warp extend between the upper and lower layer fabrics.

The basic longitudinal and lateral cover factors of the two-layer fabrics of Examples 25 to 29 were approximately 10 and 10, respectively. In Example 26, in areas of 5 mm width extending in the warp direction on opposite sides of each connecting warp, the group warps (840 d nylon filament yarns) were arranged in a higher warp density of 40 threads/inch so that the longitudinal cover factor of those areas was approximately 16. In Example 27, in areas each of 15 mm width extending in the weft direction, 840 d×2 nylon filament twist yarns, instead of the normal wefts (840 d nylon filament yarns), were inserted in a weft density of 22 threads/inch to provide a higher lateral cover factor of approximately 14 in those areas. In Example 28, an adhesive tape having a suitable width was applied to the two-layer fabric along each connecting warp. In Example 29, a hot-melt adhesive was applied to the two-layer fabric along each connecting warp in an appropriate width.

The periphery of each of those two-layer fabrics was sewn, and a pouring opening was attached to the two-layer fabric at one end of the same to form a fabric form of approximately 2 m×3 m size. The constructions of the two-layer fabrics are the same as those of FIGS. 10

TABLE 4

| Ex. No. | Disengagement system | Temporary weft | Disengaging method | Breaking Z | α | β | $P_W/P_F$ | $P_W \cdot P_F$ | |
|---|---|---|---|---|---|---|---|---|---|
| 16 | Breaking | 50d Nylon filament yarn (Tensile strength: ≈300 g) | Mechanical | — | — | — | — | — | The double layer fabric was unable to form a fabric form having uniform thickness. |
| 17 | " | 10's/2 Rayon spun yarn (Tensile strength: =1.1 kg) | " | o | o | o | o | o | Characteristics were similar to those of Ex. 12. |
| 18 | " | 3000d PET filament yarn (Tensile strength: ≈23 kg) | " | — | — | — | — | — | Temporary wefts were to strong to be broken. |
| 19 | Dissolving | Water-soluble vinylon filament yarn (High solubility) | Water treatment (Ordinary temperature) | o | o | o | o | o | Characteristics were similar to those of Ex. 12. |
| 20 | " | Water-soluble vinylon filament yarn (Low solubility) | " | — | — | — | — | — | Temporary weft could not be dissolved. |
| 21 | Melting | 1000d PVC filament yarn | Heat treatment (120° C.) | o | o | o | o | o | Characteristics were similar to those of Ex. 12. |
| 22 | " | 1000d PP filament yarn | Heat treatment (170° C.) | — | — | — | — | — | Fabric form was heat-shrunk due to excessively high temperature of the heat treatment. |
| 23 | Extraction | 3000d PET Mono filament yarn (Float-woven) | Hooking-out | o | o | o | o | o | Characteristics were similar to those of Ex. 12. |
| 24 | " | 3000d PET Mono filament yarn (Plain-woven) | " | — | — | — | — | — | Temporary wefts could not be extracted. |

and 11. The fabric form was extended from the top of a readjusted slope over the surface of the same, and then fluid concrete (water-to-cement ratio: 65%) was poured through the pouring opening into the fabrics form at a pressure of approximately 0.4 kg/cm$^2$ breaking the rayon spun yarns, namely, the temporary wefts, to form a composite structure consisting of the fabric form and concrete. The characteristics of the composite structures corresponding to Examples 25 to 29 are tabulated in Table 5. The characteristics of the composite structures of Examples 26 to 29 were the same as those of the composite structure of Example 12.

TABLE 5

| Ex. No. | Longitudinal × lateral cover factors in the vicinity of a connecting warp | Fixation of connecting warp to the ground structure | General evaluation Z | $\alpha$ | $\beta$ | $P_W/P_F$ | $P_W \cdot P_F$ | |
|---|---|---|---|---|---|---|---|---|
| 25 | 10 × 10 | — | x | o | x | o | o | |
| 26 | 16 × 10 | — | o | o | o | o | o | Characteristics were similar to those of Ex. 12. |
| 27 | 10 × 14 | — | o | o | o | o | o | " |
| 28 | 10 × 10 | Adhesive tape (Areal fixation) | o | o | o | o | o | " |
| 29 | 10 × 10 | Hot-melt adhesive (Point fixation) | o | o | o | o | o | " |

EXAMPLE 30

This example is a manner of constructing a composite structure by using the fabric form (approximately 2 m wide×5 m long) of Example 12.

The fabric form of Example 12 was extended from the top of a readjusted slope over the surface of the same with the upper side thereof fixed with stakes at the top of the slope. The fabric form was stretched tightly in both the longitudinal and lateral directions, and then the fabric form was pegged to the surface of the slope with stakes of 50 cm length. The stakes were distributed at longitudinal and lateral intervals of one meter and were driven into the ground by a length of approximately 30 cm (FIG. 30). Then, fluid concrete (water-to-cement ratio: 65%) was poured through the pouring opening provided near the upper end of the fabric form at a pressure of approximately 0.4 kg/cm$^2$ breaking the temporary wefts. The composite structure (FIG. 31) thus formed had the same characteristics as that of Example 12. The lower surface of the composite structure was laid in very close contact with the surface of the slope. No significant contraction in size occurred in the fabric form when the same was filled with concrete. This manner of constructing the composite structure was very simple and enabled very quick construction of the composite structure.

EXAMPLE 31

This example is a manner of constructing a composite structure on an irregular surface by using the fabric form (approximately 2 m wide×5 m long) of Example 19. As illustrated in FIG. 32, the fabric form was extended from the top of a slope over the irregular surface of the same with the upper side thereof fixed with stakes at the top of the slope. The fabric form was adjusted so as to be extended along the irregular surface of the slope, and then the fabric form was pegged to the irregular surface of the slope with pegs 50 cm in length. The stakes were distributed at longitudinal and lateral intervals of one meter and were driven into the ground by a length of approximately 30 cm. Then, fluid concrete (water-to-soil ratio: 60%) was poured through the pouring opening provided near the upper end of the fabric form at a pressure of approximately 0.4 kg/cm$^2$ to form a composite structure as illustrated in FIG. 33. The characteristics of this composite structure were substantially the same as those of the composite structure of Example 19. The lower surface of the composite structure was in close contact with the irregular surface of the slope. No significant contraction in size occurred in the fabric form when the same was filled with concrete. That is, the area of the fabric form remained as it was when the fabric form was laid over the irregular surface of the slope, even after the fabric form was filled with concrete. This manner of constructing the composite structure was very simple and enable very quick construction of the composite structure.

EXAMPLE 32

A two-layer fabricating a warp and weft density of 20 threads/inch and original thickness of 15 mm was prepared. The following yarns were used:

1000 d PET filament yarn . . . Ground warp and weft

10's/2 cotton yarn 10,000 d PET filament twist yarn . . . Connecting warp 300 d water-soluble Vinylon (Solblon SS made by Nichibi Co.) . . . Temporary weft Connected portions were distributed at longitudinal×lateral intervals of 30 mm×30 mm. At each connected portion, three temporary wefts each were inserted in the upper and lower layer fabrics to interlace each connecting warp with the temporary wefts at six joints so that seven connecting portions of the connecting warp extend between the upper and lower layer fabrics.

The ratio in number of 1000 d PET filament yarns to 10's/2 cotton yarn in the ground structure was 1:2. In areas of 5 mm width extending in the warp direction on opposite sides of each warp, 2000 d PET filament yarns were arranged in a warp density of 22 threads/inch so that the longitudinal cover factor of those areas was 14.3. The two-layer fabric was immersed in a resin solution containing a green pigment to dye the two-layer fabric and to dissolve the water-soluble Vinylon yarns, and dyed two-layer fabric was dried and set.

The periphery of the dyed two-layer fabric was sewn and a pouring opening was attached to the upper layer fabric to form a fabric form approximately 2 m wide×5 m long.

The fabric form was extended from the top of a slope over the irregular surface of the same with the upper side thereof fixed at the top of the slope. The fabric form was adjusted so that the same was laid along the irregular surface of the slope, and then stakes about 30 cm long were driven through the fabric form into the ground by a length of approximately 25 cm, as illustrated in FIG. 32. Then, a fluid vegetative material i.e., a soil including seeds was poured through the pouring opening into the fabric form at a pressure of approximately 0.4 kg/cm$^2$ to form a composite structure as illustrated in FIG. 33. The characteristics of the composite structure are tabulated in Table 6.

TABLE 6

| Characteristics | | | Examples | | | | | | | | | |
|---|---|---|---|---|---|---|---|---|---|---|---|---|
| | | | 10 | 11 | 12 | 13 | 14 | 15 | 32 | 33 | 39 | 40 |
| Z | Longitudinal | Mean | Unable to form a composite structure | 0.33 | 0.24 | 0.29 | *0.58 | 0.28 | 0.13 | 0.33 | 0.34 | 0.40 |
| | | Max | | 0.40 | 0.28 | 0.32 | *0.65 | 0.33 | 0.13 | 0.35 | 0.41 | 0.50 |
| | | Min | | 0.33 | 0.20 | 0.26 | *0.49 | 0.26 | 0.13 | 0.30 | 0.27 | 0.30 |
| | Lateral | Mean | | 0.33 | 0.24 | 0.29 | 0.29 | *0.60 | 0.13 | 0.33 | 0.34 | 0.40 |
| | | Max | | 0.40 | 0.28 | 0.32 | 0.31 | *0.70 | 0.13 | 0.35 | 0.40 | 0.50 |
| | | Min | | 0.33 | 0.20 | 0.26 | 0.24 | *0.53 | 0.13 | 0.30 | 0.27 | 0.30 |
| α | Longitudinal | Mean | | 5.0 | 1.51 | *0.54 | 3.1 | 1.52 | 3.66 | 4.94 | 1.85 | 5.4 |
| | | Max | | 5.1 | 1.55 | *0.56 | 3.3 | 1.56 | 3.73 | 5.01 | 1.93 | 5.5 |
| | | Min | | 4.9 | 1.48 | *0.52 | 3.0 | 1.48 | 3.56 | 4.75 | 1.75 | 5.4 |
| | Lateral | Mean | | 5.0 | 1.51 | *0.55 | 1.53 | 3.20 | 3.66 | 4.94 | 1.85 | 5.4 |
| | | Max | | 5.1 | 1.55 | *0.57 | 1.58 | 3.28 | 3.73 | 5.01 | 1.92 | 5.5 |
| | | Min | | 4.9 | 1.48 | *0.53 | 1.49 | 3.02 | 3.56 | 4.75 | 1.76 | 5.35 |
| β | Longitudinal | Max | | 1.02 | 1.03 | 1.04 | 1.06 | 1.03 | 1.02 | 1.01 | 1.04 | 1.02 |
| | | Min | | 0.98 | 0.98 | 0.96 | 0.97 | 0.97 | 0.97 | 0.96 | 0.95 | 0.99 |
| | Lateral | Max | | 1.02 | 1.03 | 1.04 | 1.03 | 1.03 | 1.02 | 1.01 | 1.04 | 1.02 |
| | | Min | | 0.98 | 0.98 | 0.96 | 0.97 | 0.94 | 0.97 | 0.96 | 0.95 | 0.99 |
| $P_W/P_F$ | | | | 1.0 | 1.0 | 1.01 | *0.49 | *2.11 | 1.00 | 1.00 | 1.00 | 1.00 |
| $P_W \cdot P_F$ mm$^2$ | | | | 900 | 10,000 | 76,450 | 4,704 | 4,653 | 900 | 6,241 | 3,540 | 400 |
| Areal contraction of the fabric form (%) | | | | 0 | 0 | 15.1 | 5.9 | 6.9 | 0 | 2.5 | 1.7 | 0 |

Note:
Asterisk (*) refers to value not meeting the conditions of the present invention.

The lower surface of the composite structure was in close contact with the irregular surface of the slope. No significant contraction in size occurred in the fabric form when the same was filled with the vegetative material and the area of the fabric form remained as it was when the fabric form was laid over the irregular surface of the slope, even after the fabric form was filled with the vegetative material. The manner of constructing this composite structure was very simple and enabled very quick construction of the composite structure. The dyed fabric form was pleasing to the eye and improved the external appearance of the composite structure remarkably. One month after the composite structure had been constructed, the cotton yarns were decomposed and plants grew thickly over the surface of the composite structure.

EXAMPLE 33

A two-layer fabric having a warp and weft density of 20 threads/inch and original thickness of 25 mm was prepared. The following yarns were used:

1000 d PP filament yarn . . . Ground warp and weft for upper layer fabric 840 d high-elongation nylon filament yarn . . . Ground warp and weft for lower layer fabric 16,000 d nylon filament yarn . . . Connecting warp 300 d paper yarn . . . Temporary weft Connected portions were distributed at longitudinal×lateral intervals of 80 mm×80 mm. In each connected portion, seven temporary wefts each were inserted in the upper and lower layer fabrics to interlace each connecting warp with the temporary wefts at 14 joints so that 15 connecting portions of the connecting warp extend between the upper and lower layer fabrics. In the central area of 15 mm width extending in the weft direction in each of the upper and lower layer fabrics in each section of the same where the connecting warps are interlaced with the ground wefts of the same, 7's/2 cotton yarns are inserted in a weft density of 25 threads/inch so that the cover factor of the area is 13.4.

The periphery of the double layer fabric was sewn, and a pouring opening was attached to the upper layer fabric to form a fabric form approximately 2 m wide×5 m long. The fabric form was extended from the top of a slope over the irregular surface of the same with the upper side thereof fixed at the top of the slope. The fabric form was stretched longitudinally and laterally, and then stakes of 50 cm length were driven through the fabric form into the ground by a length of about 30 cm to fix the fabric form to the irregular surface of the slope. Then, a mixture of water and soil (water-to-soil ratio: approx. 60%) was poured through the pouring opening disposed near the top of the slope at a pressure of approximately 0.5 kg/cm$^2$, breaking the paper yarns to construct a composite structure as illustrated in FIG. 34. The characteristics of the composite structure are tabulated in Table 6. The lower surface of this composite structure was in close contact with the irregular surface of the slope. No significant contraction in size occurred in the fabric form and the area of the fabric form remained unchanged even after the fabric form had been filled with the mixture. The surface of the composite structure had a regularly corrugated appearance. The manner of constructing the composite structure was very simple and enabled very quickly construction of the composite structure.

EXAMPLE 34

This example is a manner of constructing a composite structure on the surface of a readjusted slope by using the fabric form of Example 33. In this example, the fabric form is extended over the surface of a readjusted slope with the upper and lower layer fabrics reversed, namely, with the lower layer fabric woven of 840 d high-elongation nylon filament yarns facing up. As illustrated in FIG. 30, after extending the fabric form over the surface of the slope in the above-mentioned manner with the upper side of the same fixed to the top of the slope with stakes, the fabric form was stretched longitudinally and laterally, and then stakes of about 50 cm length were driven through the fabric form into the ground by a length of approximately 35 cm at longitudinal and lateral intervals of one meter. Then, fluid concrete (water-to-cement ratio: 65%) was poured through the pouring opening disposed near the top of the slope at a pressure of approximately 0.5 kg/cm$^2$ breaking the temporary wefts, namely, paper yarns, to form a composite structure as illustrated in FIG. 35. The characteristics of this composite structure were substantially the same as those of the composite structure of Example 32. The lower surface of this composite structure was in close contact with the surface of the slope and the surface of the same had a regular corrugated appearance. No significant contraction occurred in the fabric form, and the area of the fabric form remained as it was when the same was fixed to the surface of the slope, even after the same was filled with concrete. This manner of constructing the composite structure was very simple and enabled very quick construction of the composite structure.

EXAMPLE 35

This example uses the fabric form (approx. 2 m×5 m) of Example 8. The fabric form of Example 8 was lined with a rubber sheet to form the fabric form of this example. As illustrated in FIG. 29, the fabric form was extended over the surface of a readjusted slope with the rubber sheet in contact with the surface of the readjusted slope and with the upper side thereof fixed to the top of the readjusted slope with stakes. Then, fluid concrete (water-to-cement ratio: approx. 65%) was poured through the pouring opening disposed near the top of the readjusted slope at a pressure of approximately 0.3 kg/cm$^2$ breaking the temporary wefts, and then stakes of about one meter length were driven through the fabric form into the ground at longitudinal and lateral intervals of one meter to construct a cut-off wall as illustrated in FIG. 36. The characteristics of this composite structure, i.e., the cut-off wall, were substantially the same as those of the composite structure of Example 8. No significant contraction occurred in the fabric form. This manner of constructing the composite structure was very simple and enabled very quick construction of the composite structure.

EXAMPLE 36

This example is a manner of constructing a multilayer composite structure by using a plurality of the fabric forms of Example 8.

The fabric form (approx. 2 m wide×5 m long) of Example 8 was extended flat over the flat ground, and then fluid concrete (water-to-cement ratio: 65%) was poured into the fabric form at a pressure of approximately 0.5 kg/cm$^2$ to form a first concrete body. Then, another fabric form of Example 8 was extended flat over the first concrete body with a horizontal displacement of approximately 30 cm relative to the first concrete body and stakes of about one meter in length were driven through the fabric form into the first concrete body by a length of about 50 cm at longitudinal and lateral intervals of one meter to fix the fabric form to the first concrete body. The same fluid concrete was poured into the fabric form to construct a second concrete body. This procedure was repeated successively to construct a multilayer composite structure as illustrated in FIG. 37. Earth was banked up behind the concrete bodies at the construction of every concrete body. Since the characteristics of the component concrete bodies of the multilayer composite structure were the same as those of the composite structure of Example 8, the layers of the concrete bodies could be placed very easily one over another, the adjacent concrete bodies were in very close contact with each other, and the multilayer composite structure was stable and had a satisfactory external appearance.

EXAMPLE 37

This example is a manner of constructing a composite structure over the wall of a tunnel by using the fabric form of Example 7.

The fabric form (approx. 2 m wide×8 m long) of Example 7 was fixed to the arcuate ceiling of a tunnel excavated in the ground by driving stakes of about 70 cm length through the fabric form into the wall of the tunnel by a length of approximately 50 cm at longitudinal and lateral intervals of approximately 50 cm. When, fluid concrete (water-to-cement ratio: approx. 65%) was poured into the fabric form at a pressure of approximately 0.3 kg/cm$^2$ breaking the temporary wefts to form a substantially semicircular composite structure consisting of the fabric form and concrete as illustrated in FIG. 38. The composite structure had a uniform and smooth surface. The characteristics of the composite structure were substantially the same as those of the composite structure of Example 7.

EXAMPLE 38

This example is a manner of forming a cylindrical concrete structure by using the fabric form of Example 7.

The fabric form of Example 7 was rolled to form a cylindrical fabric form of approximately 490 mm inside diameter and approximately 3 m length. The cylindrical fabric form was covered over a steel pipe of approximately 500 mm outside diameter and was fastened at the upper and lower end thereof to the steel pipe. Then, fluid concrete (water-to-cement ratio: approx. 65%) was poured into the cylindrical fabric form through the upper end of the same at a pressure of approximately 0.3 kg/cm$^2$, breaking the temporary wefts to form a cylindrical composite structure consisting of the fabric form and concrete as illustrated in FIG. 39. The cylindrical composite structure had a uniform and substantially smooth surface. The characteristics of this composite structure were substantially the same as those of the composite structure of Example 7.

EXAMPLE 39

A two-layer fabric having a warp and weft density of 50 threads/inch and original thickness of 20 mm was prepared. The following yarns were used:

420 d nylon filament yarn . . . Ground warp and weft
2500 d nylon filament yarn . . . Connecting warp
100 d water-soluble Vinylon filament yarn . . . Temporary weft Connected portions were distributed at longitudinal×lateral intervals of 60 mm×60 mm. Pairs of connecting warps were woven so that the connecting warps of each pair were woven alternately and opposite to each other in the upper and lower layer fabrics of the two-layer fabric. In each connected portion, two temporary wefts each were inserted in the upper and lower layer fabrics for each of a pair of the connecting warps so that each connecting warp is interlaced with four temporary wefts and five connecting portions of each connecting warp extend between the upper and lower layer fabrics.

Then, the double layer fabric was coated with rubber on both sides, and then the periphery of the rubber-coated two-layer fabric was closed adhesively with a rubber paste. Then, a pouring opening was attached to the rubber-coated two-layer fabric to complete an air-tight fabric form (1.5 m wide×10 m long). The fabric form was extended on the flat ground and water was poured through the pouring opening at a pressure of approximately 0.25 kg/cm$^2$, dissolving the water-soluble Vinylon yarns to form a water-filled structure. The characteristics of the structure are tabulated in Table 6. The structure had a uniform thickness, regular surface, and satisfactory shape.

EXAMPLE 40

A two-layer fabric having a warp and weft density of 28 threads/inch and original thickness of 20 mm was prepared. The following yarns were used:

840 d nylon filament yarn . . . Ground warp and weft and connecting warp 50 d acetate filament yarn . . . Temporary weft Connected portions were distributed in an offset matrix, as illustrated in FIG. 2B, at longitudinal×lateral intervals of 20 mm×20 mm. Pairs of connecting warps were woven so that the connection of each pair were woven alternately and opposite to each other in the upper and lower layer fabrics of the two-layer fabric. In each connected portion, two temporary wefts each were inserted in the upper and lower layer fabrics for each connecting warp of a pair of the connecting warps so that each connecting warp was interlaced with the temporary wefts at four joints and thereby five connecting portions of the warp extend between the upper and lower layer fabrics. The two-layer fabric was coated with rubber on both sides, the periphery of the rubber-coated two-layer fabric was closed adhesively with rubber paste, and a pouring opening was attached to the rubber-coated two-layer fabric at one end thereof to complete an airtight fabric form (1.5 m wide×10 m long). Compressed air of 1.3 kg/cm$^2$G was blown through the pouring opening into the fabric form breaking the temporary wefts. The characteristics of the air-filled structure are tabulated in Table 6. The structure had a uniform thickness, regular surface, and satisfactory shape.

We claim:

1. A multilayer fabric comprising a plurality of layers of distinct fabrics each consisting of ground warps, ground wefts, connecting warps connecting the layers of the distinct fabrics, and temporary wefts which can be broken by external action after weaving without substantially damaging the connecting warps; the interlaced connected warps and the temporary wefts being capable of being disengaged by subjecting the multilayer fabric to external action, and fixing portions formed by increasing partially or entirely a cover factor of the ground warp as the ground weft in order to fix the connecting warp to the ground weave being provided on either or both layers of the distinct fabric, whereby the layers of the distinct fabric are separated from each other at a predetermined distance.

2. A multilayer fabric according to claim 1, wherein the connecting warps are arranged at predetermined lateral intervals and the temporary wefts are arranged at predetermined longitudinal intervals so that connected portions connecting layers of distinct fabrics are arranged at predetermined longitudinal and lateral intervals, the connecting warp being interlaced with wefts in the order of the ground wefts of a ground portion in one layer of the distinct fabrics, at least one weft in the connected portion, and the ground wefts of a ground portion in another layer of the distinct fabrics.

3. A multilayer fabric according to claim 2, wherein the temporary wefts are arranged on both layers of the distinct fabrics and the each connecting warp is only interlaced with the temporary wefts of the two layers in the connected portion.

4. A multilayer fabric according to claim 2, wherein at least one temporary weft is arranged on one layer and/or another layer of the distinct fabrics and each connecting warp is interlaced with the temporary weft and at least one ground weft such that when the temporary weft is broken, the layers of the distinct fabrics can be separated by the connected portion of the connecting warp sliding through the ground weft in the connected portion.

5. A multilayer fabric according to claim 1, wherein the fixing portions are formed by an external fixing means being applied to a suitable portion which the connecting warp interlaces with the ground weft.

6. A multilayer fabric according to claim 5, wherein the external fixing mean is an adhesive tape.

7. A multilayer fabric according to claim 2, wherein the ground wefts engaged with end portions of the connecting portion of the connecting warp or ground wefts where the connecting portion slides against are reinforced.

8. A multilayer fabric according to claim 7, wherein the ground wefts are reinforced by adding an additional ground warp.

9. A multilayer fabric according to claim 7, wherein the ground wefts are reinforced by using stronger ground wefts in place of the original ground wefts.

10. A multilayer fabric comprising a plurality of layers of distinct fabrics each consisting of ground warps, ground wefts, connecting warps connecting the layers of the distinct fabrics and arranged at predetermined lateral intervals, and temporary wefts connecting the layers of the distinct fabrics and arranged at predetermined longitudinal intervals, and fixing portions formed by increasing partially or entirely a cover factor of the ground warp as the ground weft in order to fix the connecting warp to the ground weave being provided on either or both layers of the distinct fabric, engagement between the connecting warps and the temporary wefts being broken to separate the layers of the distinct fabrics from each other by a predetermined distance.

11. A multilayer fabric according to claim 10, wherein connecting portions of the connecting warps extend in a direction inclined toward the layer of the fabric from one layer to another layer.

12. A multilayer fabric according to claim 10, wherein the connecting portions of the connecting warps extend in a direction substantially perpendicular to the layer of the fabric from one layer to another layer.

13. A fabric form comprising a multilayer fabric, peripheral edges of which are close and having at least one pouring opening; the multilayer fabric being comprised of a plurality of layers of distinct fabrics, each consisting of ground warps, ground wefts, connecting warps connecting the layers of the distinct fabrics, and temporary wefts which can be broken by external action after weaving without substantially damaging the connecting warps, or already broken at places interlacing with the connecting warps, and fixing portions formed by increasing partially or entirely a cover factor of the ground warp as the ground weft in order to fix the connecting warp to the ground weave being provided on either or both layers of the distinct fabric.

14. A composite structure comprising a fabric form and filling matter filled into the fabric form; said fabric form being comprised of a multilayer fabric, peripheral edges of which are closed and having at least one pouring opening; the multilayer fabric being comprised of a plurality of layers of distinct fabrics, each consisting of ground warps, ground wefts, connecting warps connecting the layers of the distinct fabrics separated by a predetermined distance, and temporary wefts interlaced with the ground warps except for places interlaced with the connecting warps, and fixing portions formed by increasing partially or entirely a cover factor of the ground warp as the ground weft in order to fix the connecting warp to the ground weave being provided on either or both layers of the distinct fabric;

the composite structure satisfying the following conditions:

$$\tan 0° < Z < \tan 25° \quad \text{(a)}$$

where

Z indicates a degree of flatness of a surface of the composite structure and equals h/(P/2), P (mm) being a length of an interval between two adjacent joints in the longitudinal direction or in the lateral direction of the composite structure, h (mm) being a height of a maximum convex portion measured from a plane including the two adjacent joints of the outermost layer of the composite structure;

$$\alpha = 1 \sim 20$$
$$\beta = 0.8 \sim 1.2 \quad \text{(b)}$$

where $\alpha$ equals T/P and $\beta$ equals $\alpha n/\overline{\alpha}$, T (mm) being a thickness of the composite structure, measured from a joint of the upper layer fabric to a joint of the lower layer fabric, $\alpha n$ being an individual value of $\alpha$, and $\overline{\alpha}$ having a mean value of $\alpha n$; and $$P_W = (0.8 \sim 1.2) \cdot P_F$$

$$P_W \cdot P_F = 100 \sim 100{,}000 \text{ mm}^2 \quad \text{(c)}$$

$P_W$ (mm) indicating the value of P in the longitudinal direction of the composite structure, and $P_F$ (mm) indicating the value of P in the lateral direction of the composite structure.

* * * * *

UNITED STATES PATENT AND TRADEMARK OFFICE

CERTIFICATE OF CORRECTION

PATENT NO. : 4,853,269

DATED : August 1, 1989

INVENTOR(S) : Kunihiko Fukomori et al.

It is certified that error appears in the above-identified patent and that said Letters Patent is hereby corrected as shown below:

Claim 13, col. 32, line 60:

"close" should be --closed--.

Signed and Sealed this

Twenty-second Day of May, 1990

*Attest:*

HARRY F. MANBECK, JR.

*Attesting Officer*

*Commissioner of Patents and Trademarks*